US007185891B2

(12) United States Patent
Jackson

(10) Patent No.: US 7,185,891 B2
(45) Date of Patent: Mar. 6, 2007

(54) WAGERING CARD GAME

(75) Inventor: Kathleen Nylund Jackson, Scituate, MA (US)

(73) Assignee: Precedent Gaming, Incorporated, Scituate, MA (US)

( * ) Notice: Subject to any disclaimer, the term of this patent is extended or adjusted under 35 U.S.C. 154(b) by 247 days.

(21) Appl. No.: 10/823,387

(22) Filed: Apr. 13, 2004

(65) Prior Publication Data

US 2005/0087928 A1 Apr. 28, 2005

(51) Int. Cl.
*A63F 1/00* (2006.01)
*A63F 13/00* (2006.01)

(52) U.S. Cl. ..... 273/292; 273/274; 463/12

(58) Field of Classification Search ..... 273/292, 273/309, 274; 463/12, 13
See application file for complete search history.

(56) References Cited

U.S. PATENT DOCUMENTS 5,673,917 A * 10/1997 Vancura ..... 273/292
5,839,730 A 11/1998 Pike ..... 273/292
6,170,828 B1 * 1/2001 Mostashari ..... 273/292
6,179,291 B1 1/2001 Vancura ..... 273/292
6,217,024 B1 * 4/2001 Lofink et al. ..... 273/292
6,375,189 B1 4/2002 Jones ..... 273/292

OTHER PUBLICATIONS

"Blackjack", Scarne's Encyclopedia of Game by John Scarne, Harper & Row Publishers, 1973, pp. 276-286.*

* cited by examiner

*Primary Examiner*—Benjamin Layno
(74) *Attorney, Agent, or Firm*—Mark A. Litman & Associates, P.A.

(57) ABSTRACT

A wagering game has a dealer compete against a player. The at least one player and the dealer receive a single card. The at least one player takes at least one mandatory hit card. If the at least one mandatory hit card has the specific relationship in rank to the single card, or if the at least one mandatory hit card allows the at least one player to continue the game, the player having the option of taking another hit card. When the player has elected to take no more hits or has taken a maximum number of hits, but has not taken a card that busts, the dealer taking at least one mandatory hit card the dealer taking hits until the dealer busts, until the dealer receives a predetermined maximum number of cards, or until the dealer has received a total number of cards that exceeds the total number of cards in all players' hands in the game.

29 Claims, 17 Drawing Sheets

WAGERING CARD GAME

BACKGROUND OF THE INVENTION

1. Field of the Invention

The present invention relates to gaming play, particularly card gaming play, and wagering card games that may be played as a casino table card game, a console station for multiple players or as a video slot machine game.

2. Background of the Art

Casinos regularly desire to obtain new games to maintain player interest and excitement. Although the traditional games of Blackjack (twenty-one), Bacarrat, and Poker (and its variants) have been staples at casinos, additional games have been regularly added for variety and stimulation. Even variations of standard games such as blackjack have been introduced, with games such as 13—Over and Under (a side bet wager game), Spanish Twenty-One™ game enjoying some success. Many poker variants have been introduced, such as Let It Ride® poker, Caribbean Stud® poker, Three-Card™ poker, and the like. The benefits of these poker variant games include the fact that any number of players (up to the table limit and the cards available from the deck) may play games either against the dealer's hand or against a pay table. Even single players may play some of these games, with or without a dealer hand.

Even Casino War™ card game has achieved some level of play in casinos because it is easy to understand, competitive, and some extended play can be enjoyed at the table at moderate cost levels. These are definite attributes of casino games. It is always desirable to develop new and additional games for play in casinos, especially those that can be quickly learned, have a level of excitement and expectation to them, and have strategies that are easily understood.

One game that enables play of a side bet with a stream of cards being sought is described in U.S. Pat. No. 5,839,730 which describes a unique method for a wagering game achieved by providing a side bet opportunity during the play of a Twenty-One game. The player is given the opportunity to place this side bet with the hope of receiving winnings when certain predetermined card configurations are received. Upon receipt of these defined card configurations, the player is immediately paid winnings during the process of the Twenty-One game. These additional winnings are based on sequences of cards and are independent and separate from wagers in the Twenty-One game. Additionally, all of the predetermined card configurations are preferably chosen such that they will not interfere with the underlying Twenty-One game. As a basis for paying out winnings, it is required that the player consecutively receive these certain card configurations during the play of the Twenty-One game after having made a bet in expectation of those card configurations appearing. Also, the final configuration of the Twenty-One hand is irrelevant to the side bet game as the players win immediately when the predetermined configurations are received, long before completion of the hand.

U.S. Pat. No. 6,375,189 describes casino table card play in general terms. In a casino card game, provisions are made for a jackpot component awarded after initially dealt cards are reviewed and additional cards are dealt, in which predetermined prizes are awarded players who participate in the jackpot component by placing additional wagers and the prizes are based upon preselected arrangements of playing cards in the hands after additional cards are dealt. There is no sequence of cards in order described and the disclosure is for bonus games and jackpots.

U.S. Pat. No. 6,179,291 (Vancura) describes a casino table wagering game in which random events and their associated values are used (e.g., card rank). The teachings include a set of higher/lower hitting and standing rules in which a participant's successive event values are compared to determine the success or failure of a strategic decision. As a table game vs. a house dealer, the overall player's objective in a preferred embodiment is not to bust while achieving more hits than the dealer who plays by a fixed set of rules. Variations include a solitaire version, different payoff criteria and schedules, different definitions of what constitutes a successful hit, versions with a guaranteed-winner bonus round, and the introduction of jokers which may be helpful and/or harmful to the player's hand. When the dealer busts, the player automatically wins.

SUMMARY OF THE INVENTION

A wagering card game has at least one player competing against a dealer. An object of the game in determining a win versus a loss is to achieve a hand with the greatest number of cards possible (up to a general rule maximum of 6 cards or an alternate 7-card maximum) without busting and to have a greater number of cards in the player's hand then the dealer has in the dealer's hand. Awards are based upon the degree of the player's hand exceeding the number of cards in the dealer's hand as a multiple of an initial wager. Certain events may enable a player to double down or even triple down, providing a game feel similar to blackjack. Additional events may include special situations and strategies that provide the player extra benefits for receiving pairs, suited cards, or close-value cards. The game may be played as a live casino table game with physical cards, or with various virtual systems such as a stand alone video gaming apparatus or a console multi-player format with seats for up to seven or more players and a video display of a dealer hand or even of a dealer.

DETAILED DESCRIPTION OF THE INVENTION

Figure 1:
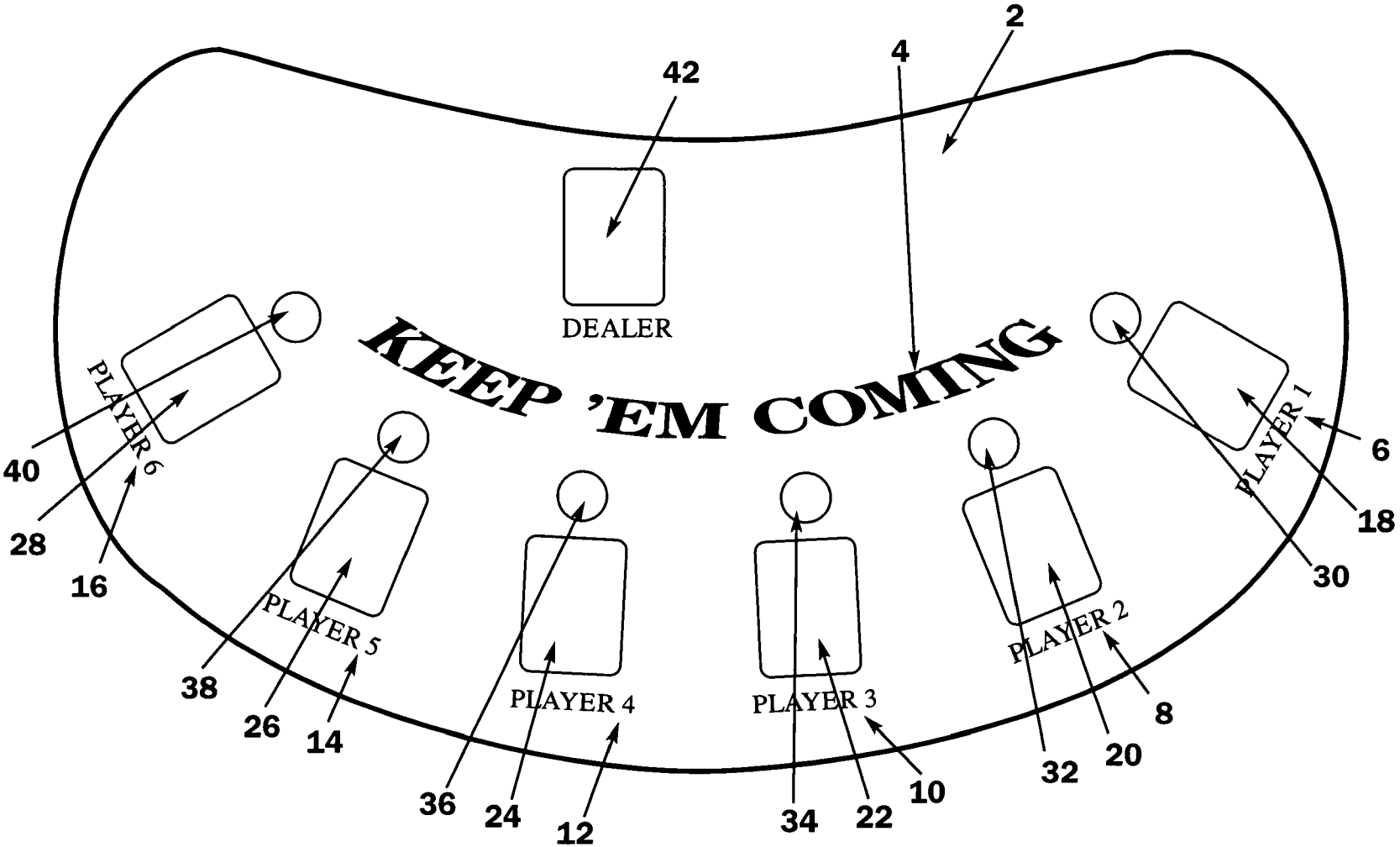
FIG. 1 shows a layout of a casino table game felt.

The basic game is played as follows. Each player places a game wager. After each player has placed a game wager, each such player receives a single card and the dealer receives a single card. Preferred play requires that the dealer's card be visible to all players, although the player's first card may be dealt face down. It is also preferred that each player's card be visible to the table.

Each player places a game wager, against the dealer (the house or casino), or in a Card Room format, one player acts as the banker. After each player has placed a game wager, each such player receives a single card and the dealer receives a single card (acting as the house, casino or holding cards for a player-banker). Preferred play requires that the dealer's card (banker's card) be visible to all players. It is also preferred that each player's card be visible to the entire table.

Upon viewing a player's card, that player estimates the likelihood of successfully receiving a card (and subsequent cards, one-at-a-time) that are sequentially higher in rank. The player must take at least one hit in every game to attempt to get an at least two-card hand. Aces can be high or low, and are referred to as a swing card, as receiving an Ace means that the received card was always higher then the previous card (unless that was also an Ace), and the Ace then becomes the lowest possible card with respect to the next hit (lowest except for another Ace).

After the player takes the mandatory first hit, with all players having to conclude their hitting prior to the dealer taking hits, the hand is re-evaluated. The player may consider whether or not another hit should be risked. If a player receives a card lower then the previously displayed card, that hit is considered a bust, and the player loses the wager on that round of play. There are rules that are exceptions to this general method of play that will be explained later.

After all players have concluded their hitting (by busting and/or staying), the dealer must take as many hits as possible, until busting or achieving a hand with 6-cards, or a hand with more cards then every remaining player hand on the table.

Payouts are proportionally based, with:

- a 1:1 payout on the original wager if the player's final hand has one card more then the dealer's final hand,
- a 2:1 payout on the original wager if the player's final hand has two cards more then the dealer's final hand,
- a 3:1 payout on the original wager if the player's final hand has three cards more then the dealer's final hand, and
- a 4:1 payout on the original wager if the player's final hand has four cards more then the dealer's final hand.

The payout on the initial wager cannot exceed 4:1 according to these particular rules. If every hand has a maximum of 6 cards and a minimum (as explained later) of 2 cards, the differential cannot exceed four cards.

There are special situations and strategies that may be undertaken in the play of the game. Among the special rules are at least the following:

1) When a player or dealer takes a hit and the hit card matches the value of the previous card, that event is not a bust, but is rather a Perfect Pair™ hit. The player (or dealer) not only is still in the game, but receives an additional card from which a bust cannot occur. That additional "free card" also determines the starting point or reference point for the next hit. For example, if the player hits to the previous card of a seven and receives a seven as the hit card, this is not a bust. The player also immediately receives another card, for example a six. In considering the next hit, the reference card for a bust/no bust situation is now the six.
2) If the dealer's first exposed card is a specific predetermined rank, such as a Jack or Queen, the player may elect to double down before his first hit. The rest of the player's play options remain the same for a doubled wager.
3) If the dealer's first exposed card is another predetermined rank, such as a King, the player may elect to triple down (make an additional wager on a single card so that the total wager is three times the value of the initial play wager was) the wager.

These and other features of the invention are described in the following further description, including a mathematical analysis of optimal hitting and play strategies for the game.

With respect to game strategies and variations that are within the skill of the artisan to make, the following can be considered as non-limiting examples. In the step where after all players have concluded their hitting (by busting and/or staying), the game may be modified by controlling dealer options. The play may require that the dealer must take as many hits as possible, until busting (with the maximum dealer count allowed to be six cards), the dealer may be required to take hits until achieving a hand with 6 cards, or the dealer must take hits until the dealer hand has more cards then every remaining player hand on the table. When the dealer hand busts, the dealer hand is not out of the game. Rather, the number of cards that the dealer had in sequence according to the rules of the game becomes the value against which player hands are judged.

With respect to player required hits, as previously noted, every player must take at least the first hit, and the player cannot stand, even with a King shown.

FIG. 1 shows the layout of a casino table game felt 2. The suggested table game name, Keep 'Em Coming™ 4, is silk screened on the felt. Six player positions 6, 8, 10, 12, 14 and 16 are indicated by a card outline 18, 20, 22, 24, 26 and 28 and a wagering circle area 30, 32, 34, 36, 38 and 40. The dealer's position 42 is also indicated.

Figure 2:
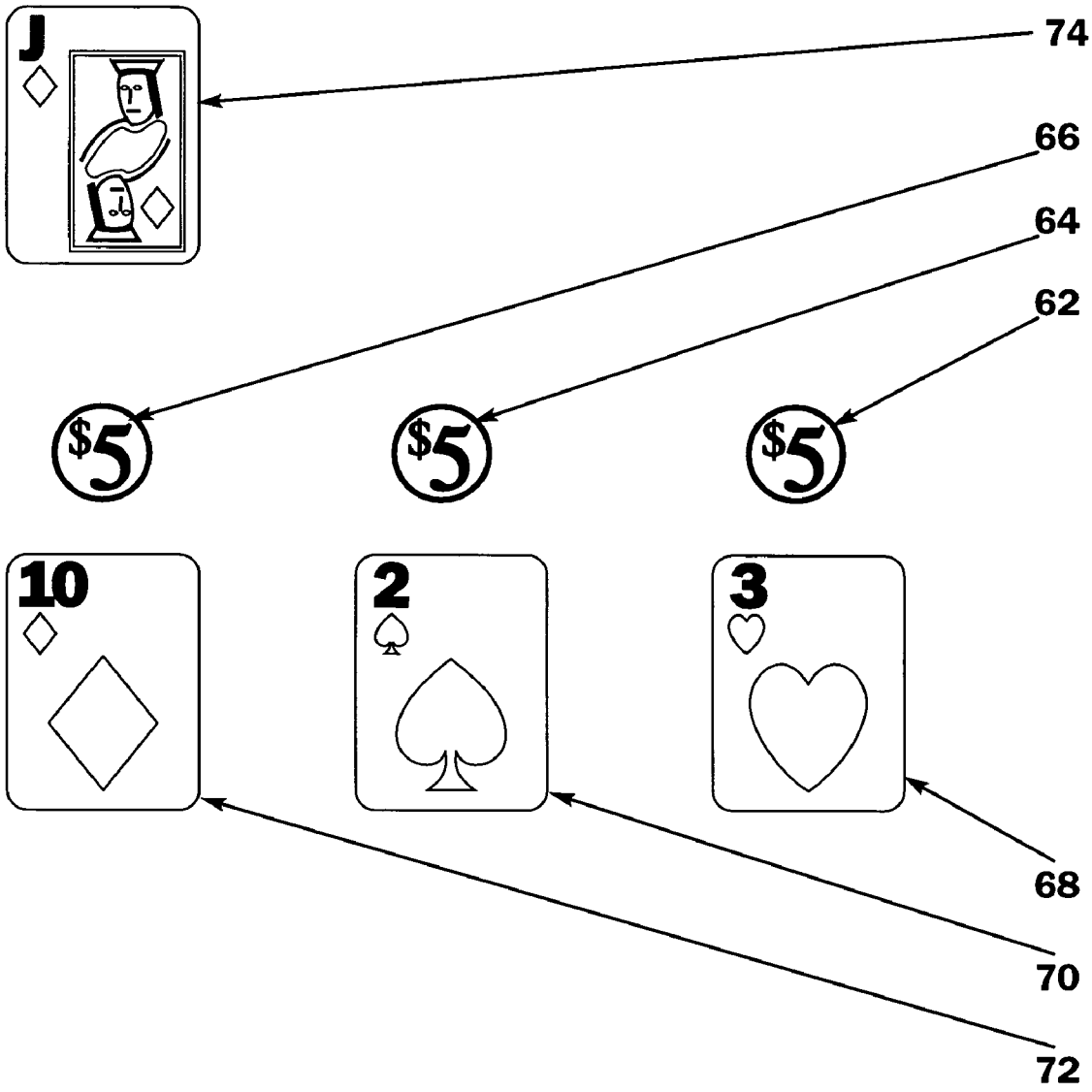
FIG. 2 shows table content where three players have wagered, and the initial card in the deal to each player and the dealer.

FIG. 2 shows the table content layout of Player 1's $5 wager 62, Player 2's $5 wager 64, and Player 3's $5 wager 66. The initial deal is shown, with all players's hands 68, 70 and 72 and the dealer initial hand 74 each receiving a single face-up card.

Figure 3:
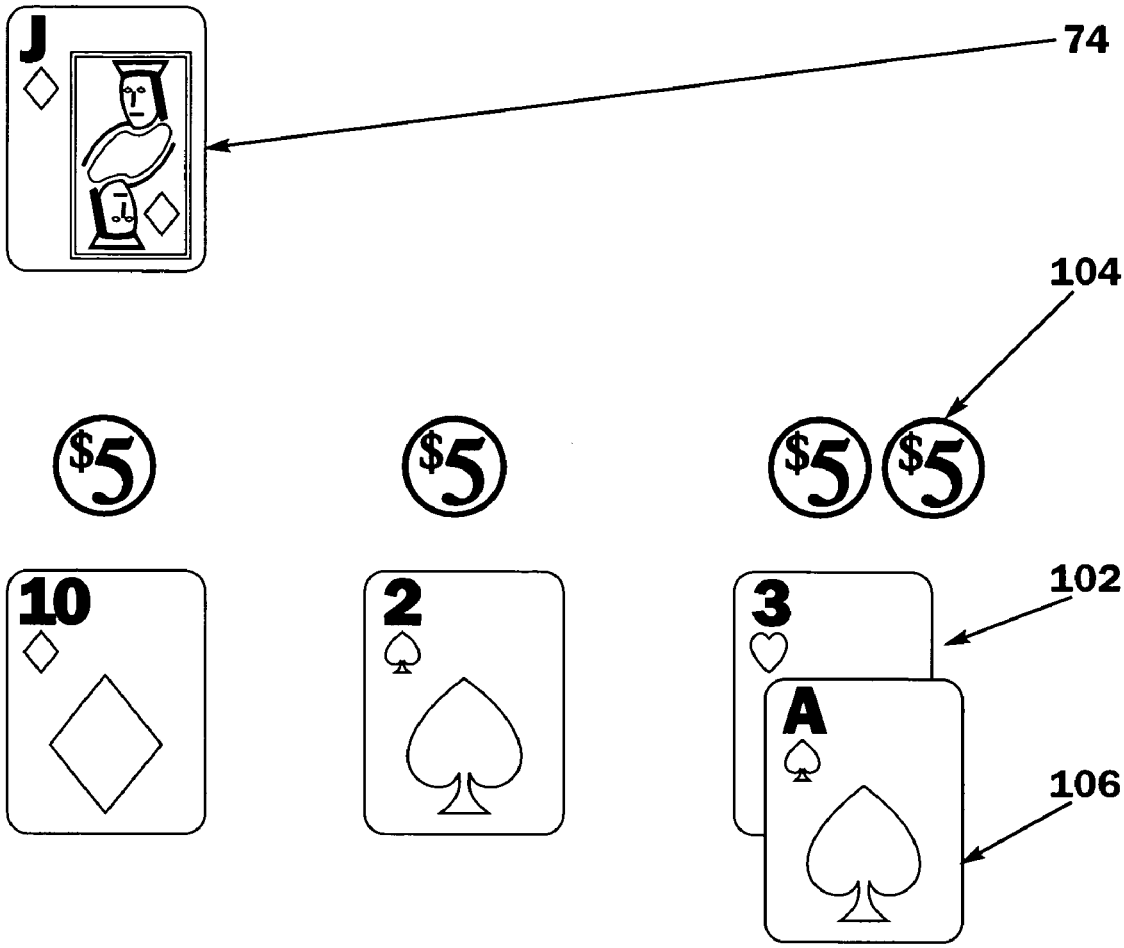
FIG. 3 shows the table content of Player 1 in the initial deal of FIG. 2 doubling a wager against the dealer's Jack, and receiving a mandatory card.

FIG. 3 shows the table content layout of Player 1 (on the right) 102 doubling the initial wager 104 against the dealer's Jack 74, and receiving the mandatory card 106. Since it is an Ace, it is considered as both high and low, so it allows to player to continue hitting, if desired.

Figure 4:
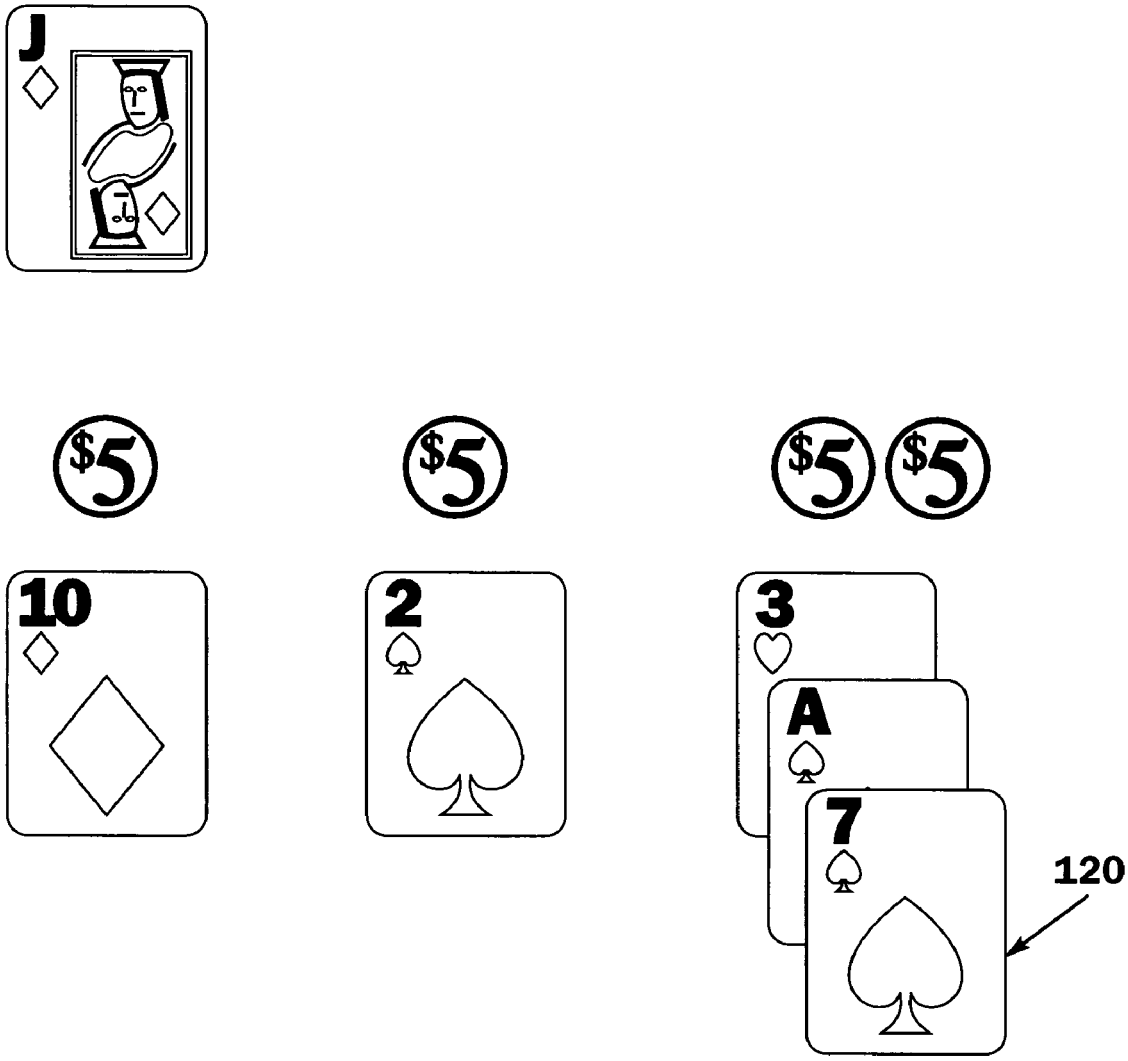
FIG. 4 shows the table content of Player 1 taking a hit.

FIG. 4 shows the table content layout of Player 1 taking a hit, and receiving a 7 120.

Figure 5:
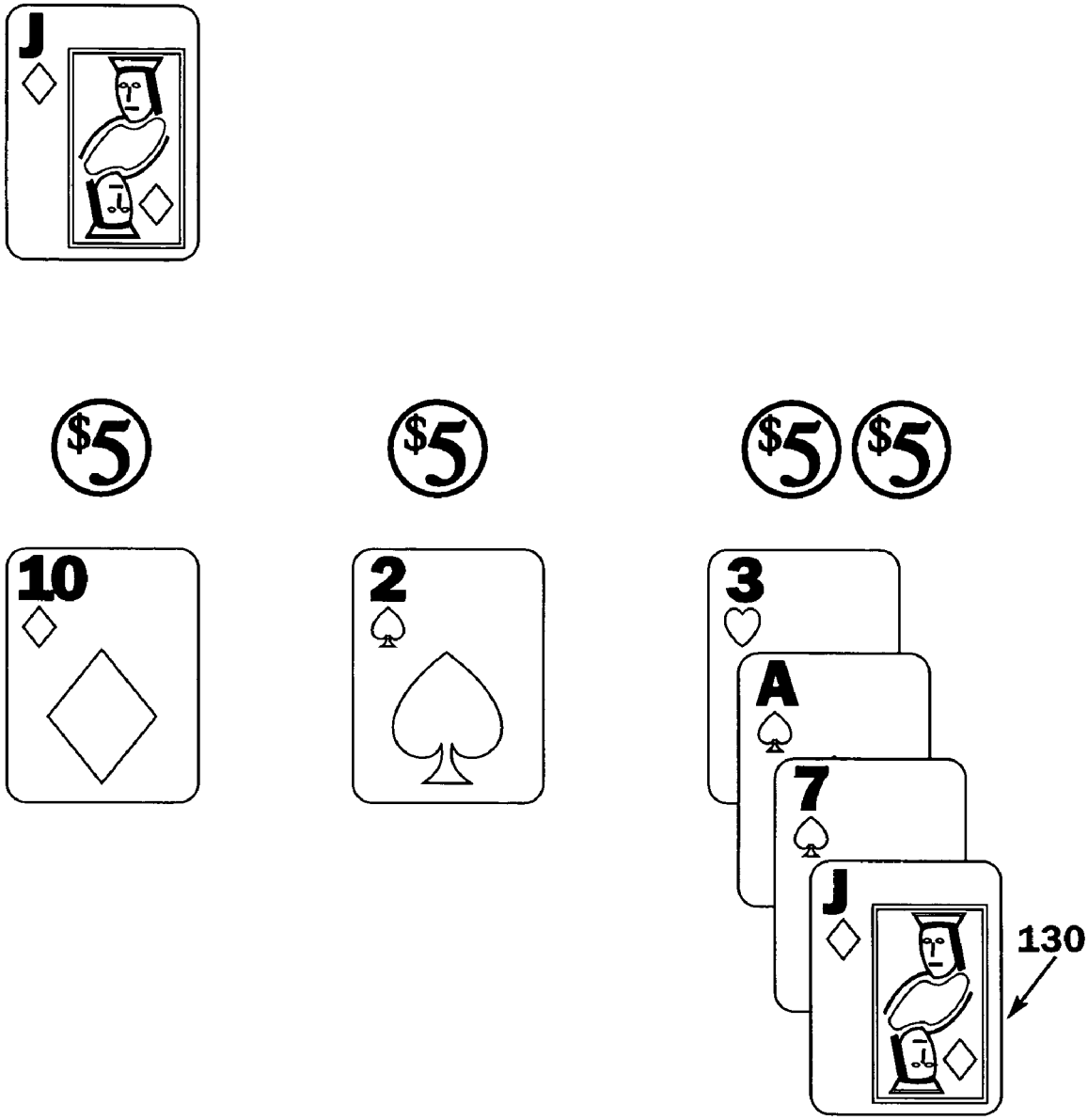
FIG. 5 shows the table content of Player 1 hitting again.

FIG. 5 shows the table content layout of Player 1 hitting again, receiving a Jack 130.

Figure 6:
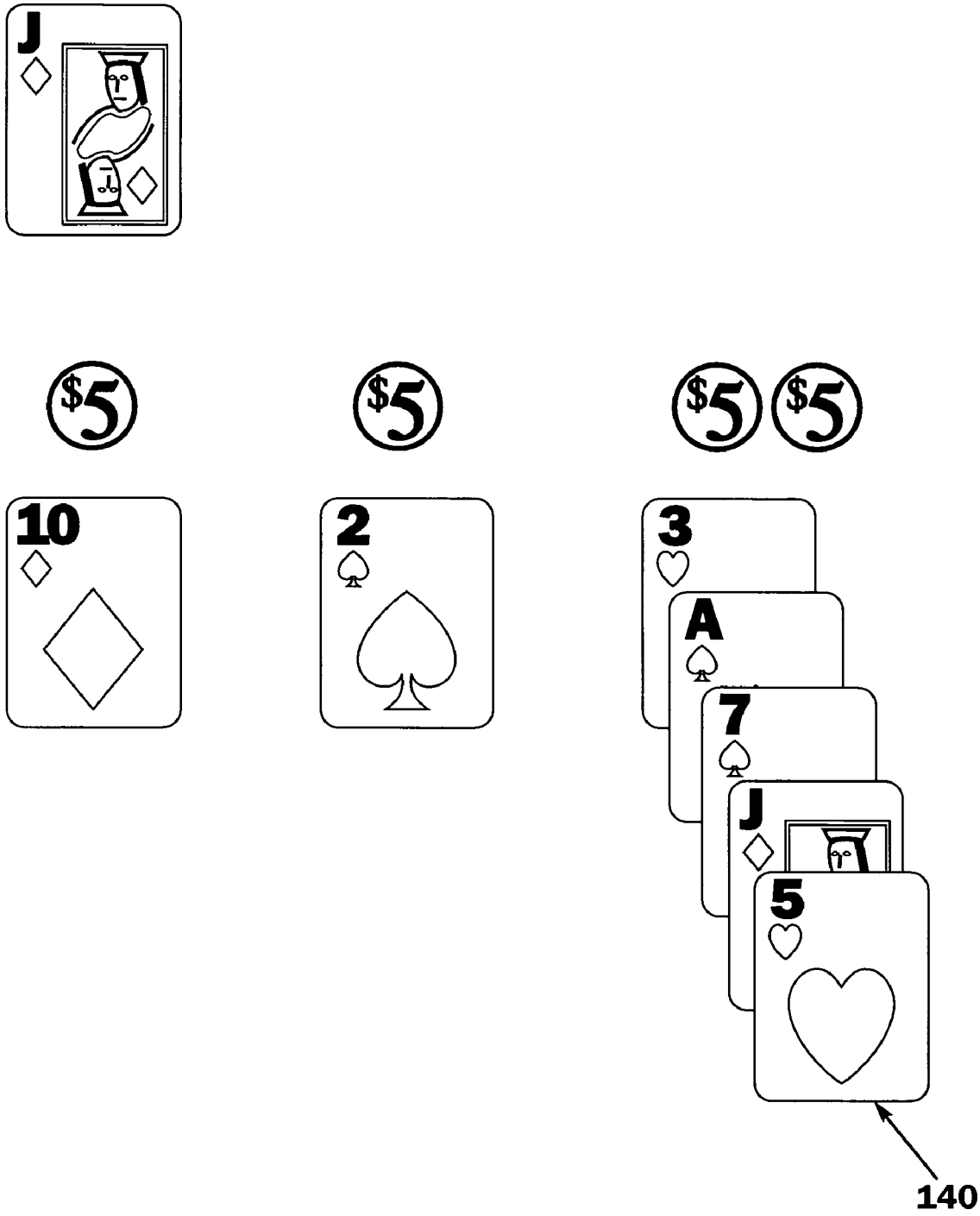
FIG. 6 shows the table content of Player 1 hitting again, but receiving a bust card.

FIG. 6 shows the table content layout of Player 1 hitting again, but this time receiving a 5 140. Since it is a lower card, the hand busts.

Figure 7:
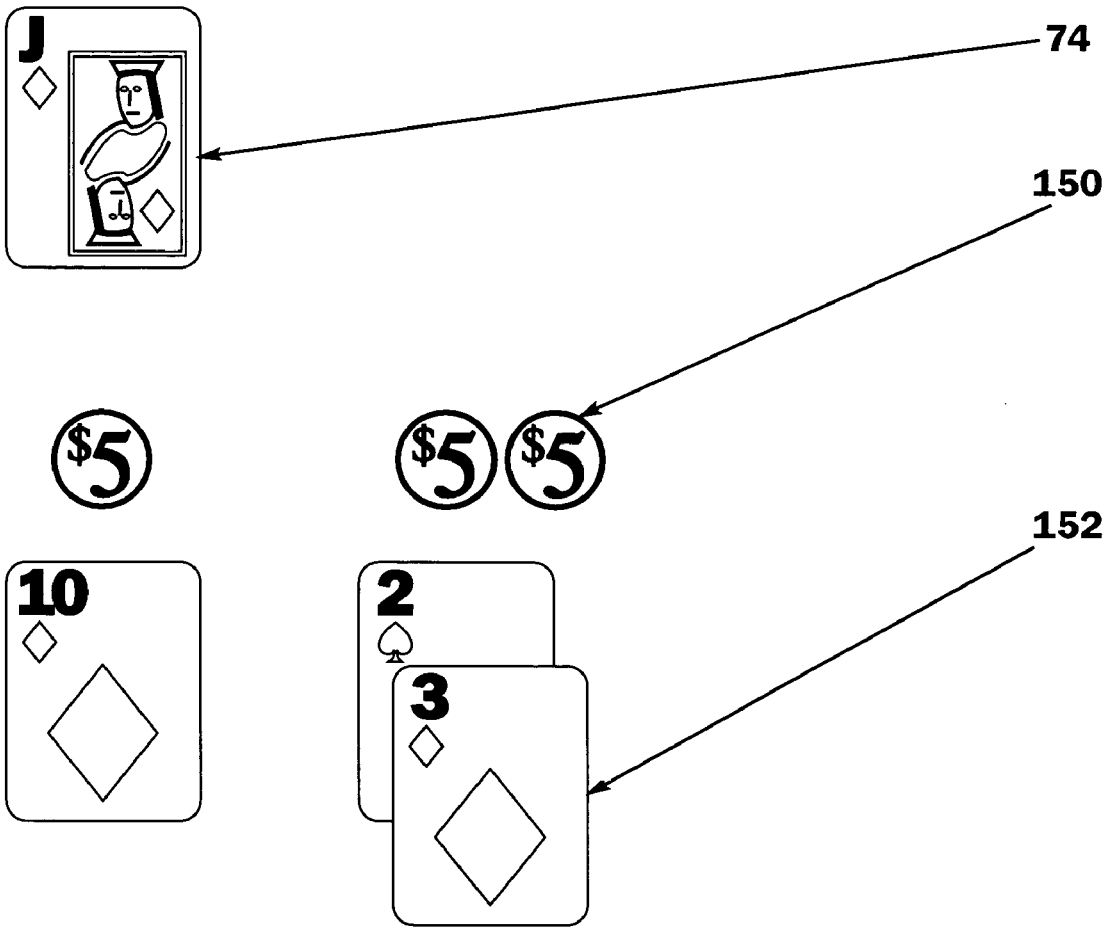
FIG. 7 shows the table content after Player 1's cards and Player 1's wager have been removed. Player 2 has doubled against the dealer's Jack, and has received the mandatory card.

FIG. 7 shows the table content layout after Player 1's cards and wager removed. Player 2 has doubled his wager 150 against the dealer's Jack 74, and has received the mandatory card (a 3) 152.

Figure 8:
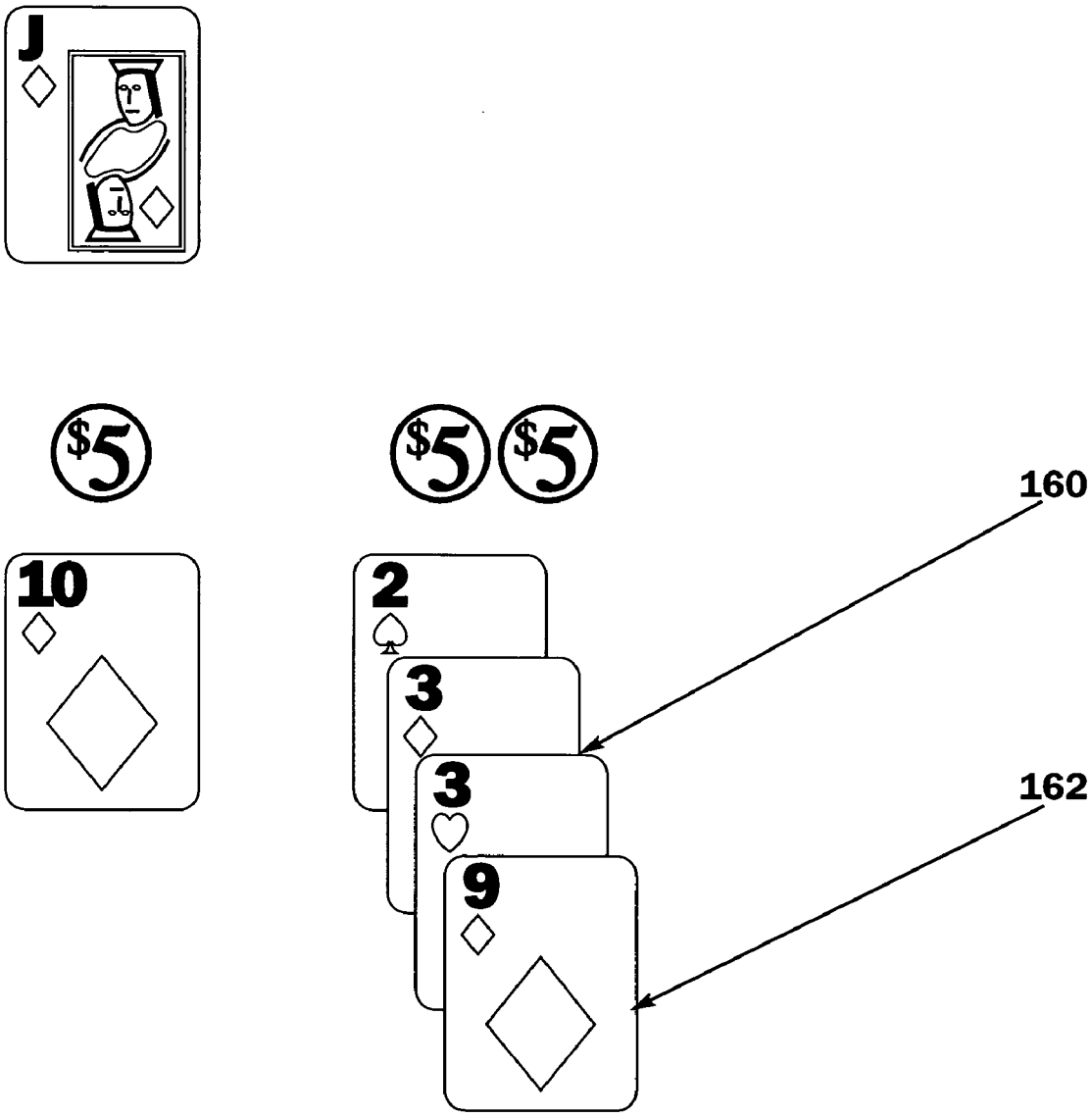
FIG. 8 shows the table content of Player 2 hitting, receiving a Pair of 3s, and a Free Card.

FIG. 8 shows the table content layout of Player 2 hitting, receiving a Pair of 3s 160, and a Free Card (a 9) 162.

Figure 9:
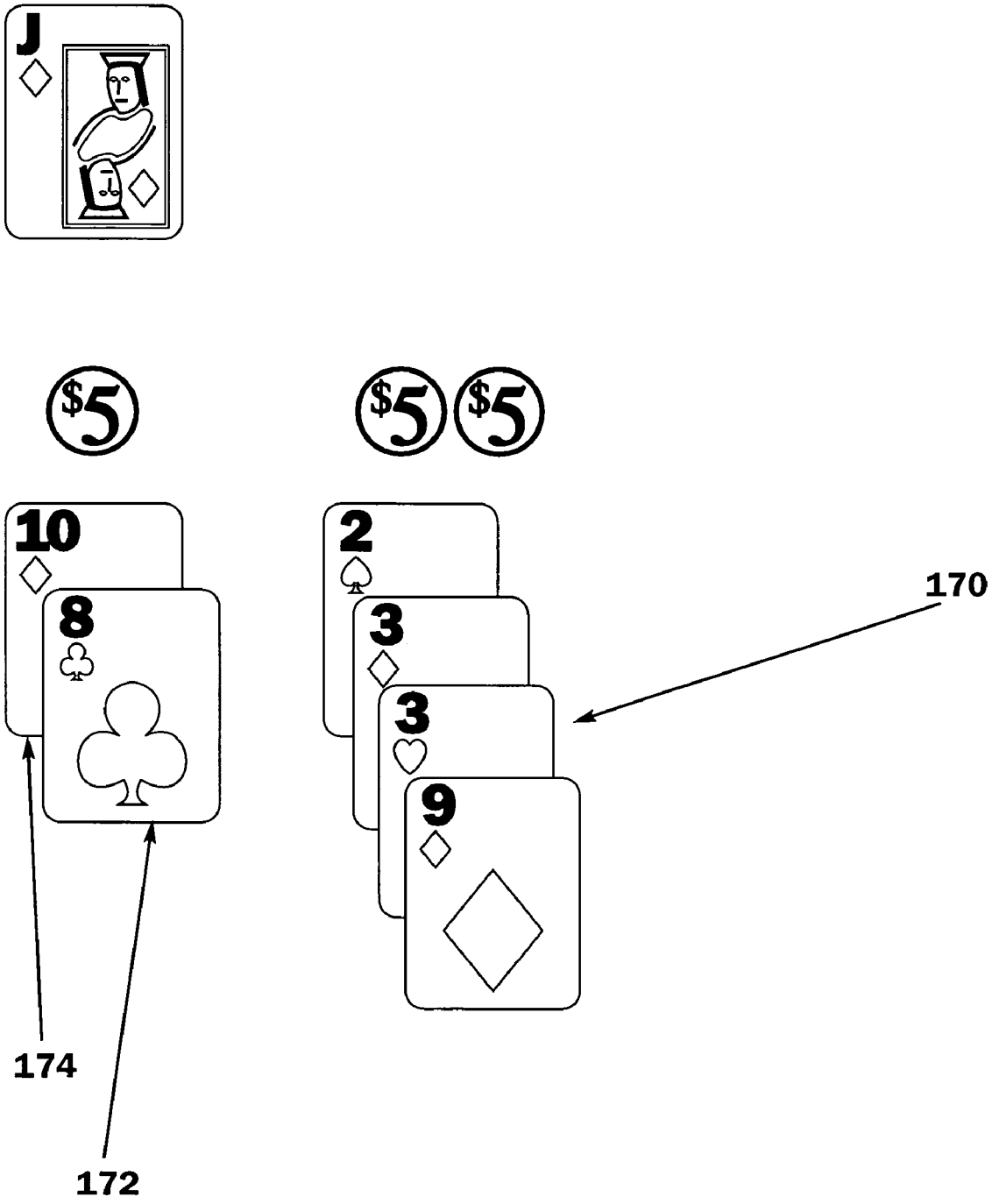
FIG. 9 shows the table content of Player 2 standing on his 4-card hand, and Player 3 receiving the mandatory card.

FIG. 9 shows the table content layout of Player 2 standing on his 4-card hand 170, and Player 3 receiving the mandatory card 172. Even though the mandatory card 172 is lower in value than the initial card 174, the mandatory card 172 is "Close Enough", allowing the player to stand with a 2-card hand.

Figure 10:
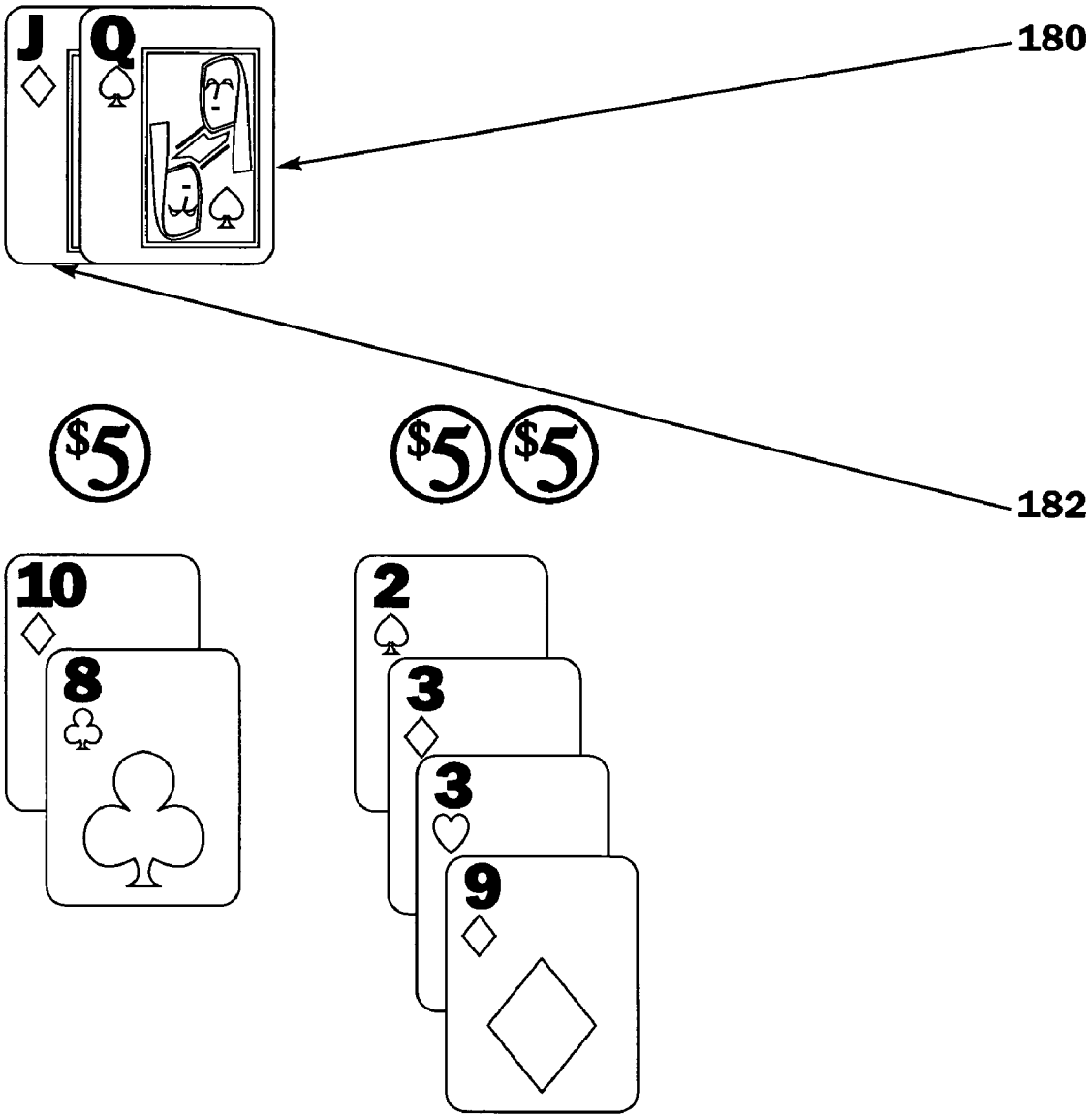
FIG. 10 shows the table content of dealer's first hit after player's have completed hitting.

FIG. 10 shows the table content layout of the dealer's first hit 180, a Queen, to his initial card, a Jack 182.

Figure 11:
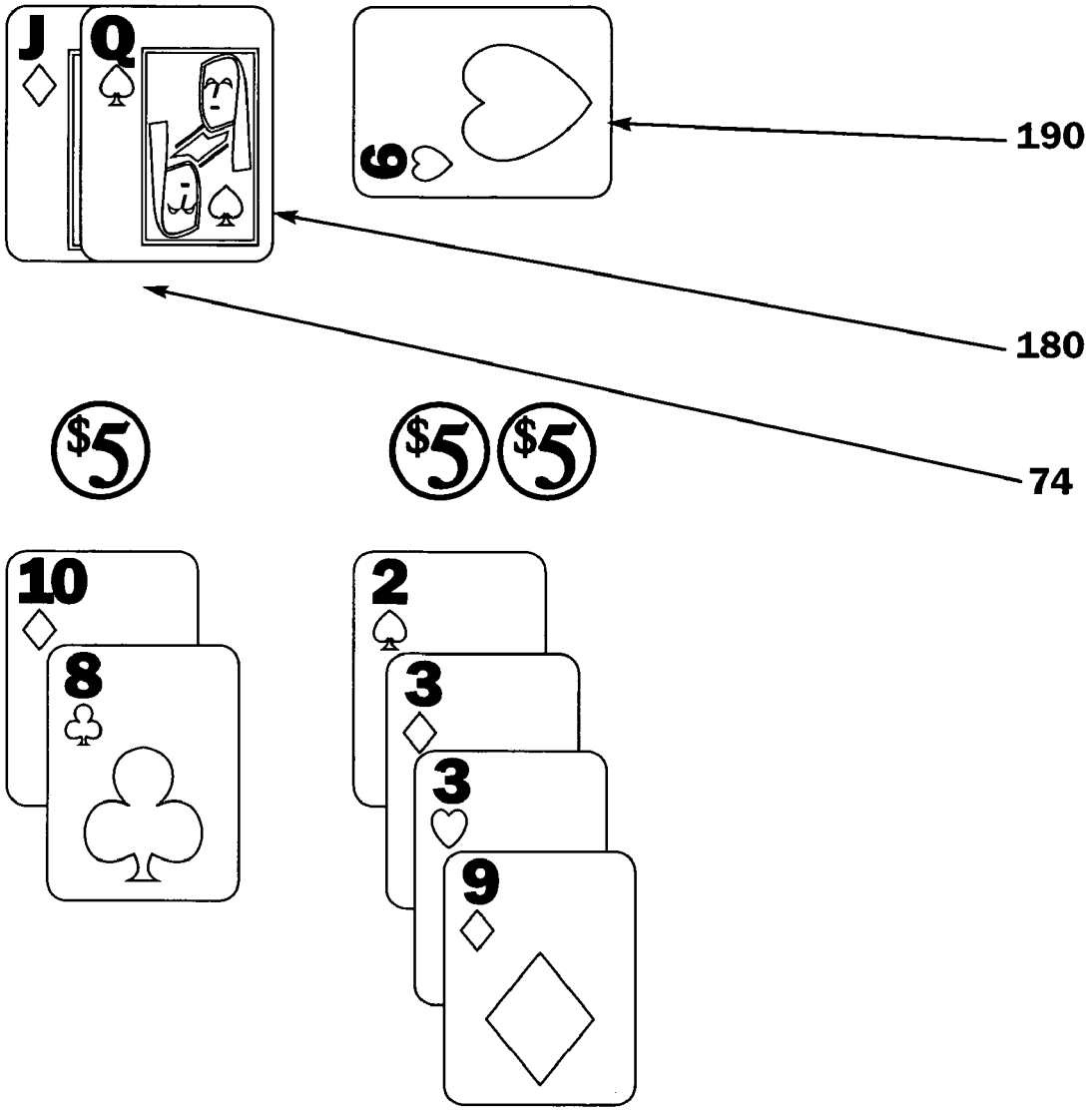
FIG. 11 shows the table content of dealer's second hit, a bust card that is put off to the side of the dealer's hand.

FIG. 11 shows the table content layout of the dealer taking another hit card 190, but it is a 6, lower than the Queen hit card 180. The 6 190 becomes a bust card which is put off to the side of the dealer's hand 74.

Figure 12:
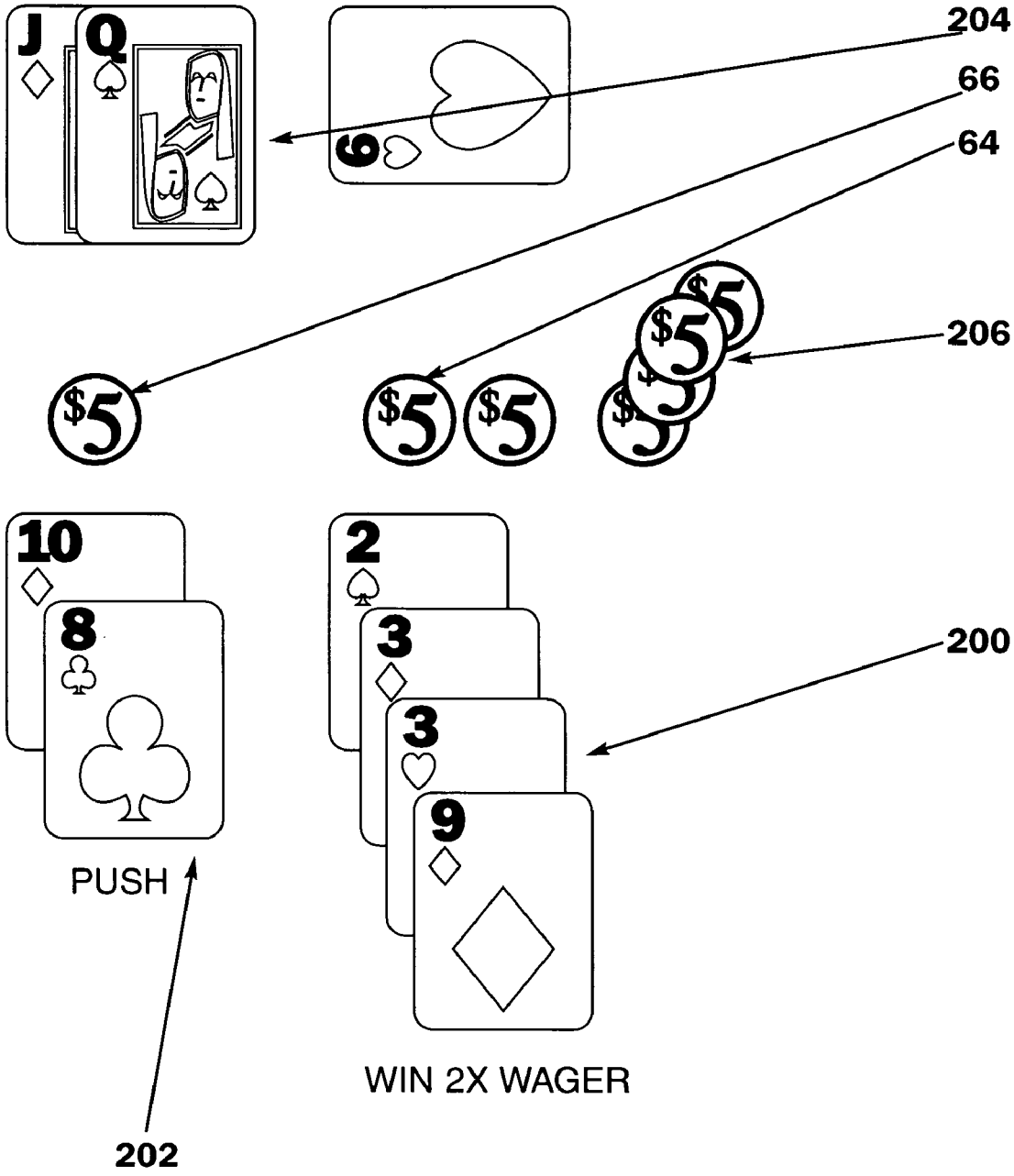
FIG. 12 shows the table content of resolution of the wagers.

FIG. 12 shows the table content layout of the resolution of the remaining wagers 64 and 66. Player 2 has a hand of 4 cards 200, Player 3 has a hand of 2 cards 202, and the dealer has a hand of 2 cards 204. Player 2 wins 2× his wager of $10 206 because said player's hand has 2 cards more than the dealer's hand. Player 2 is paid $20. The number of cards in Player 3's hand equals the number of cards in the dealer's hand, so the wager is a push.

Figure 13:
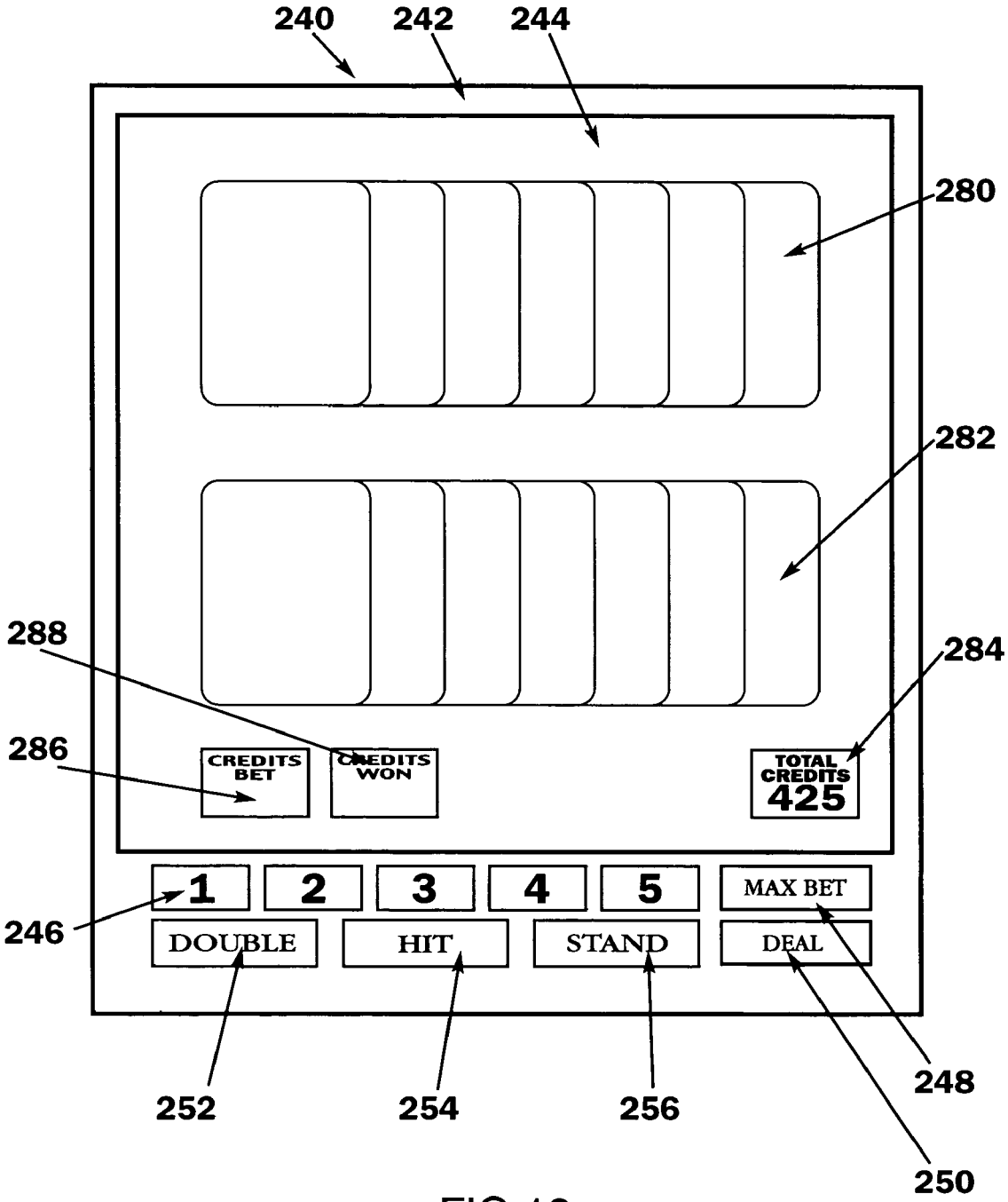
FIG. 13 shows a slot machine version of the invention, with screen monitor and play buttons.

FIG. 13 shows a slot machine version of the invention 240, with monitor 242, screen 244 and play buttons. Play buttons include numbered buttons for choosing wager amounts 246, a Max Bet button 248, a Deal button 250, a Double the Initial Wager button 252, a Hit button 254 and a Stand button 256. On the screen is shown the card area for the dealer 280, the card area for the player 282, Total Credits Available 284, Credits Bet 286 and Credits Won 288.

Figure 14:
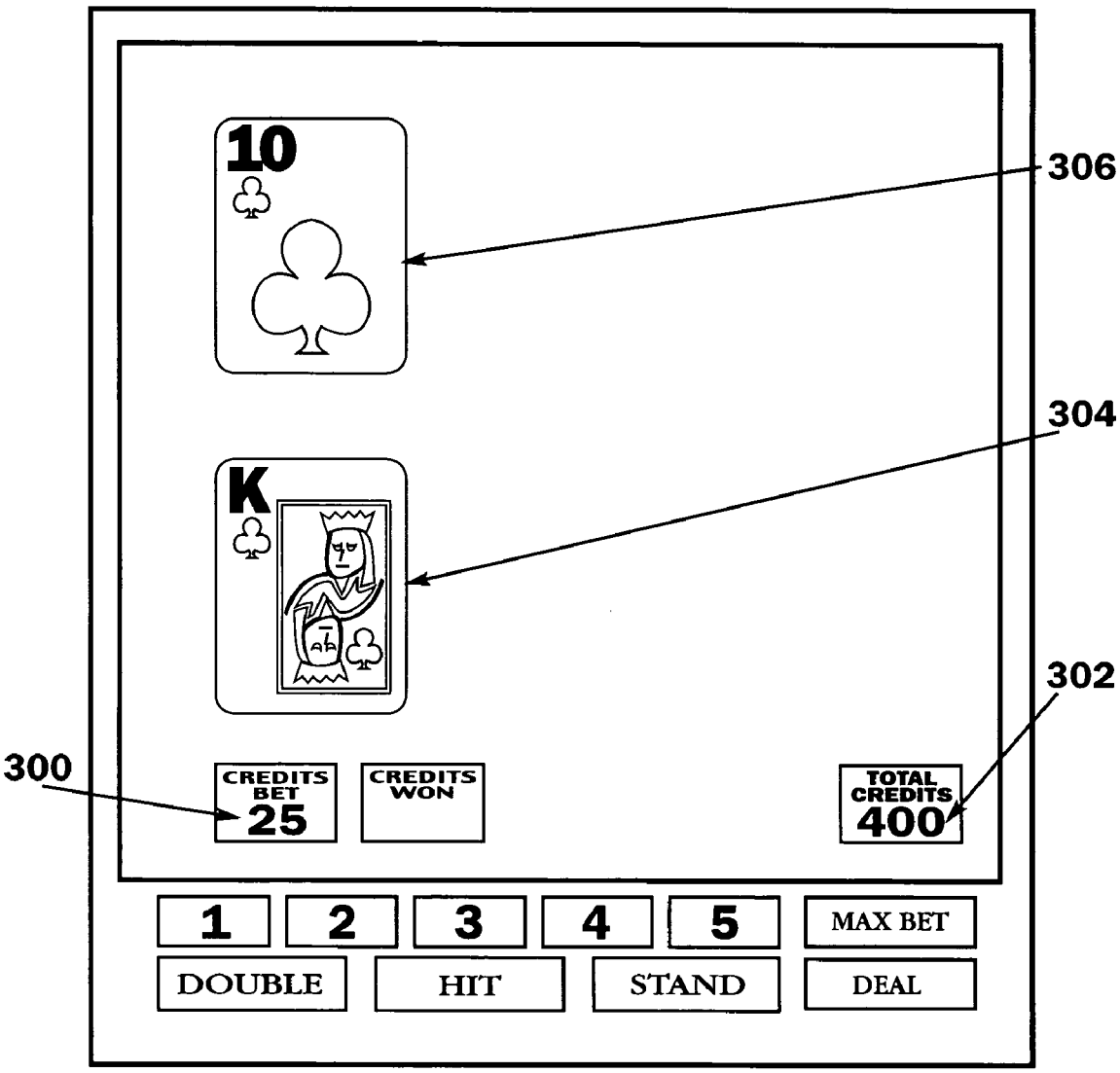
FIG. 14 shows the wager and the initial deal on a slot machine version of the invention.

FIG. 14 shows a screen display of a wager of 25 credits 300, with 25 credits being deducted from the Total Credits 302. The player has received an initial single card face up 304, a King. The dealer has received an initial single card face up 306, a 10.

Figure 15:
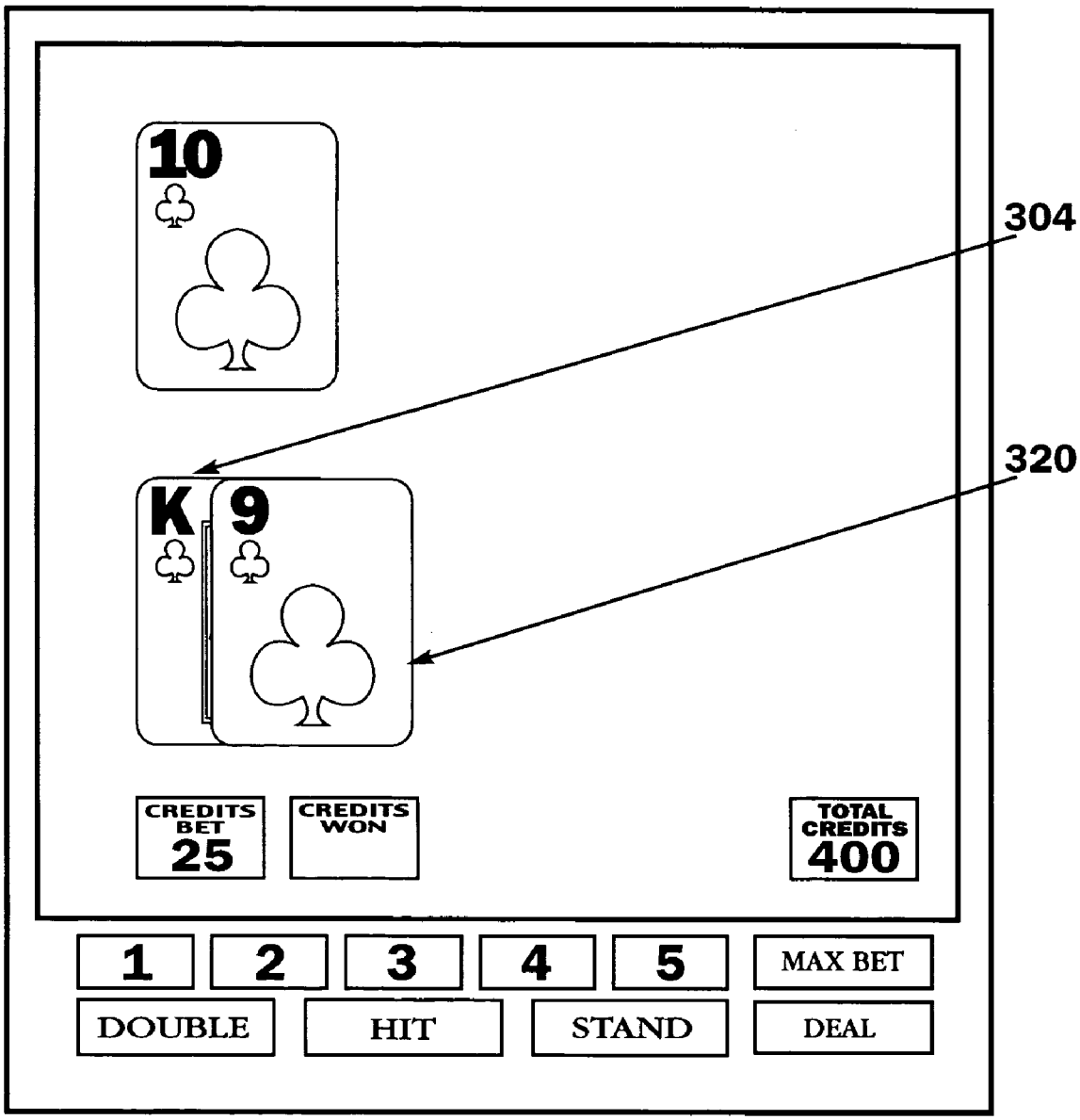
FIG. 15 shows the screen display of a player's mandatory first hit card.

FIG. 15 shows a screen display of the player's mandatory card 320, a 9, which is lower in value than the initial card 304, but in the same suit. This "Safe Suit" allows the player to continue hitting if desired.

Figure 16:
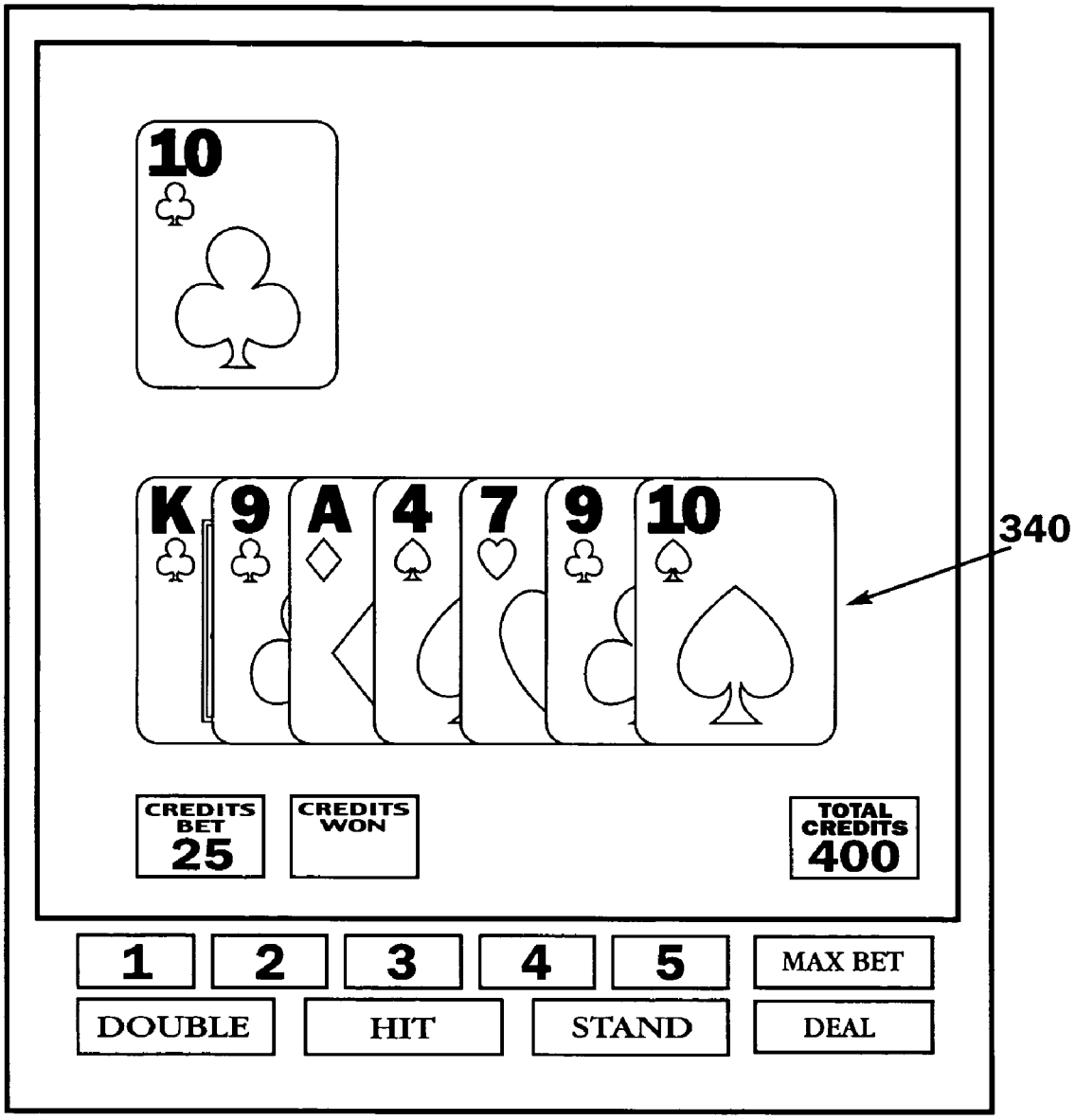
FIG. 16 shows a screen display of a player's hand after continuing to hit until a maximum hand of 7 cards (a "7-card Savannah") is achieved.

FIG. 16 shows a screen display of the player's hand 340 after continuing to hit until a maximum hand of 7 cards (a "7-card Savannah") is achieved.

Figure 17:
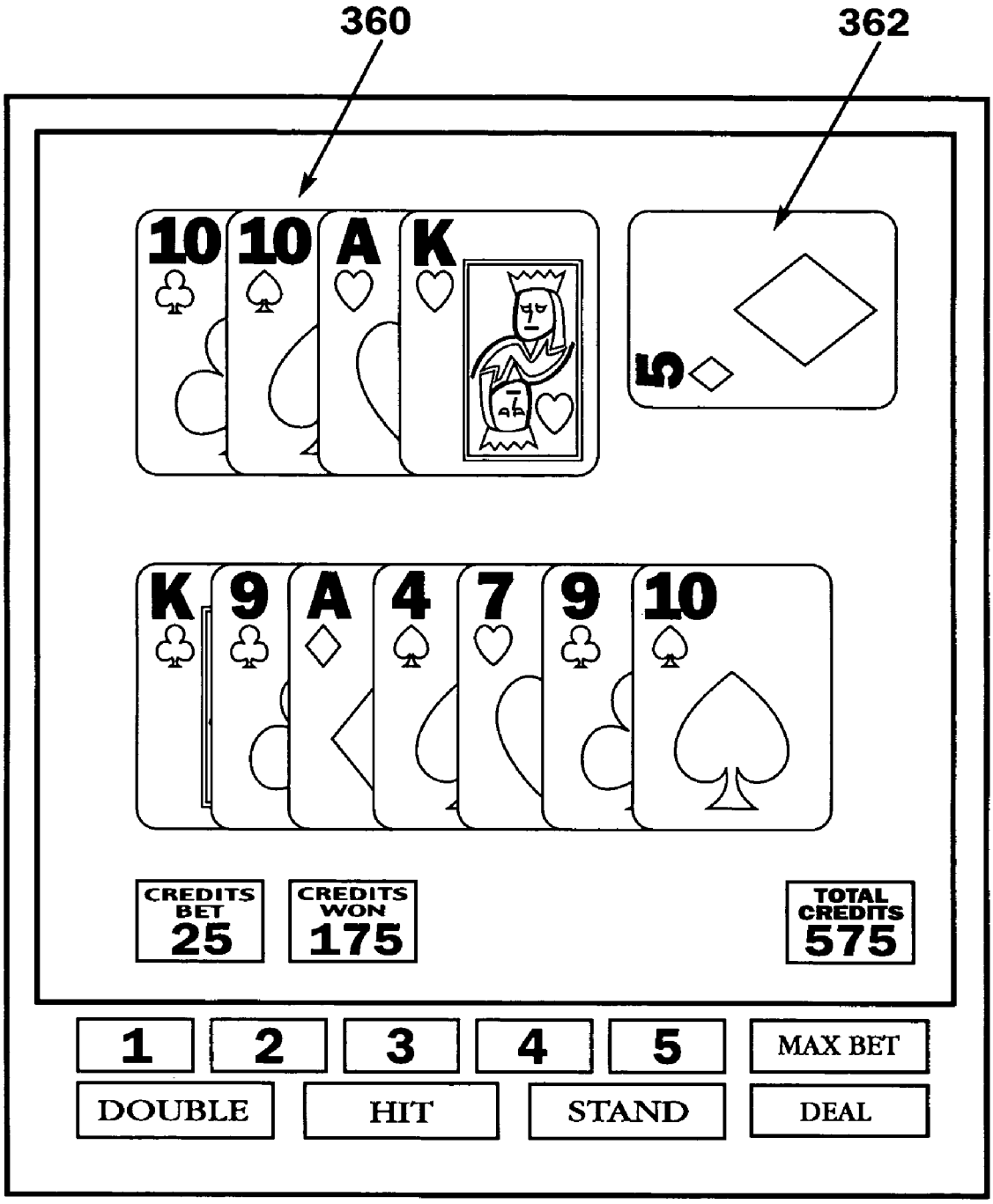
FIG. 17 shows a screen display of completion of the dealer's hand, and a bonus payout for a "7-card Savannah".

FIG. 17 shows a screen display of the final dealer's hand of 4 cards 360, with the bust card 362 off to the side. Since the dealer did not tie the player's 7-card hand (which would have produced a push) the player receives the bonus payout for a "7-card Savannah", an automatic 7× the wager payout. A different bonus award may be provided, such as an absolute amount, dependent or not on the amount of the initial wager, or even participation in a jackpot event, including but not limited to a progressive jackpot event. The win of 175 credits is shown, and has been added to the Total Credits.

Rules of Play

Keep'em Coming is a new casino table game for up to 6 players, utilizing preferably 8 decks of cards. The game may also be played on a video slot machine, using at least one virtual deck of 52 cards. The game play consists of being dealt one face-up card at a time, and then playing on the numeric value of that card, trying to make a run of cards that always increases in value. For instance, A-4-8-J-K. Kings are the highest. Aces act as a valuable "swing card"—it is high and low, so it automatically starts a new series within a run.

After seeing the first card and the dealer's up card, the player may have the option to double or triple down. Triple-down can only be made versus a dealer K up. The player also can surrender half the bet on the first card if surrender is allowed 1. If the difference in value between the first and second cards is 4 or more (e.g., 9 and 3), then the hand busts.
2. If the difference in value between the first and second cards is 3 or less (e.g., J and 8), then instead of busting, the hand has a run of 2 cards. No more cards may be drawn.
3. If a hand receives two like cards (a pair) in a row, a free card is automatically drawn. Even if the free card is lower, the hand does not bust and new cards can continue to be drawn. The free card, like an Ace, always starts a new series.

When all players have drawn, all remaining players' hands go up against the dealer's. The dealer then plays out his hand according to the rules mentioned above. The dealer must continue to draw until he either busts or has 6 cards. However, when the dealer busts, the cards drawn before the bust card will be counted as the dealer's run of cards. For example, the dealer would have a run of 3 cards in 3-A-K-8. If the dealer keeps drawing until the dealer busts, and has received more than 6 cards, the dealer's hand is considered to have a run of 6.

Players are paid the difference between the number of cards in their hand versus the dealer. For example, if the player has a run of 6 cards and the dealer has 2 cards, the player would get a payoff of 4× their bet. The player loses if he gets fewer cards than the dealer does. All ties are a push.

There may also be a rule in play referred to as "Close Enough," which may be purely favorable to the player, or may be played favorable to both the player and the dealer. When the player takes the mandatory first hit, if the first hit card is a bust card, but is within a defined range of values near the first card, the player remains in the game with a count of two cards, but can take no more hits. For example, if the first hit card is less then the first card by 3 units or fewer (e.g., if the first card were an 8, this would include a first hit with a 5, 6 or 7 if the "Close Enough" value were three or less), the player would remain in the game with a card count of two-cards. In all instances where Close Enough occurs, the player (or the dealer with the Close Enough hand) cannot take any more hits. The Close Enough play is usually limited to only the first mandatory hit.

As an alternative to "Close Enough" play, a different method of play for the mandatory second card would be the exclusion of "Close Enough," and the inclusion of "Safe Suit." If the player's mandatory card is lower than the rank or count of the first card, but the suit of the mandatory card is the same as the first card, the hand does not bust. More cards may or may not be drawn to the two-card hand, according to local rules. The dealer may or may not get the advantage of Safe Suit, and may or may not get the advantage of the Free Card after Pairing. The player may or may not be allowed to double or triple down as directed by local rules.

Another alternate method of play would increase the maximum number of cards per hand to seven. The play would incorporate the rules of the basic game herein known as "Keep 'em Coming", with the addition of a bonus feature. The bonus feature, called "7-card Savannah", allows the player to automatically win 7× his bet if the said player has achieved a 7-card hand, and the dealer has achieved a hand of 1 to 6 cards. However, if the dealer also achieves a 7-card hand, the game is a push (tie). There may be an "insurance" bet that guarantees the player an automatic reduced payoff (4-to-1, for example) for an additional wager of up to the initial wager.

Mathematical Analysis

A recursive computer program was written to determine the optimal strategy and the house advantage.

A forward- and backward-propagating method of iteration was employed to calculate the optimal way for the player to play each possible hand. In general, at each decision point consisting of 1) the number of cards in the player hand and 2) the dealer's up card, the software calculated the expected outcomes from standing and hitting, evaluated the outcomes, and selected the better of the two as the correct decision. The expected outcome from the optimal decision at each decision point was properly weighted and returned to the immediate previous decision point. All such outcomes were then summed and returned to its previous decision point until the final control of the software was back to the initial decision point. The more favorable of the two outcomes was added to the player's overall return.

The optimal strategy player will double down 7.71% of the time. 21.35% of the player hands will bust on the second card. When not busted, the player hand will average 2.1 cards. The winning frequency is 29.16%. The house advantage is 2.47% per initial wager or 2.3% per total wager. If surrender is allowed, the house advantage will be 1.32% per initial wager or 1.23% per total wager.

The accuracy of the analysis was verified by a 2-billion hand computer simulation. No card counting study was conducted.

The optimal strategies for 1-, 2- and 3-card hands are shown below (4- and 5-card hands are too numerous to enumerate here):

h . . . hit s . . . stand d . . . double r . . . surrender b . . . busted

2-Card Strategy

Rows are the 1st card and columns are the 2nd card.

| — | A | 2 | 3 | 4 | 5 | 6 | 7 | 8 | 9 | T | J | Q | K |
|---|---|---|---|---|---|---|---|---|---|---|---|---|---|
| Dealer A up: | | | | | | | | | | | | | |
| A | h | h | h | h | h | h | h | h | h | h | h | h | s |
| 2 | h | h | h | h | h | h | h | h | h | h | h | h | s |
| 3 | h | s | h | h | h | h | h | h | h | h | h | h | s |
| 4 | h | s | s | h | h | h | h | h | h | h | h | h | s |
| 5 | h | s | s | s | h | h | h | h | h | h | h | h | s |
| 6 | h | b | s | s | s | h | h | h | h | h | h | h | s |
| 7 | h | b | b | s | s | s | h | h | h | h | h | h | s |
| 8 | h | b | b | b | s | s | s | h | h | h | h | h | s |
| 9 | h | b | b | b | b | s | s | s | h | h | h | h | s |
| T | h | b | b | b | b | b | s | s | s | h | h | h | s |
| J | h | b | b | b | b | b | b | s | s | s | h | h | s |
| Q | h | b | b | b | b | b | b | b | s | s | s | h | s |
| K | h | b | b | b | b | b | b | b | b | s | s | s | h |
| Dealer 2 up: | | | | | | | | | | | | | |
| A | h | h | h | h | h | h | h | h | h | h | h | h | s |
| 2 | h | h | h | h | h | h | h | h | h | h | h | h | s |
| 3 | h | s | h | h | h | h | h | h | h | h | h | h | s |
| 4 | h | s | s | h | h | h | h | h | h | h | h | h | s |
| 5 | h | s | s | s | h | h | h | h | h | h | h | h | s |
| 6 | h | b | s | s | s | h | h | h | h | h | h | h | s |
| 7 | h | b | b | s | s | s | h | h | h | h | h | h | s |
| 8 | h | b | b | b | s | s | s | h | h | h | h | h | s |
| 9 | h | b | b | b | b | s | s | s | h | h | h | h | s |
| T | h | b | b | b | b | b | s | s | s | h | h | h | s |
| J | h | b | b | b | b | b | b | s | s | s | h | h | s |
| Q | h | b | b | b | b | b | b | b | s | s | s | h | s |
| K | h | b | b | b | b | b | b | b | b | s | s | s | h |
| Dealer 3 up: | | | | | | | | | | | | | |
| A | h | h | h | h | h | h | h | h | h | h | h | s | s |
| 2 | h | h | h | h | h | h | h | h | h | h | h | s | s |
| 3 | h | s | h | h | h | h | h | h | h | h | h | s | s |
| 4 | h | s | s | h | h | h | h | h | h | h | h | s | s |
| 5 | h | s | s | s | h | h | h | h | h | h | h | s | s |
| 6 | h | b | s | s | s | h | h | h | h | h | h | s | s |
| 7 | h | b | b | s | s | s | h | h | h | h | h | s | s |
| 8 | h | b | b | b | s | s | s | h | h | h | h | s | s |

1-card Strategy*

| — | A | 2 | 3 | 4 | 5 | 6 | 7 | 8 | 9 | T | J | Q | K | <= Dealer up card |
|---|---|---|---|---|---|---|---|---|---|---|---|---|---|---|
| A | h | h | h | h | h | h | h | h | h | h | h | h | d | |
| 2 | h | h | h | h | h | h | h | h | h | h | h | h | d | |
| 3 | h | h | h | h | h | h | h | h | h | h | h | d | d | |
| 4 | h | h | h | h | h | h | h | h | h | h | h | d | d | |
| 5 | h | h | h | h | h | h | h | h | h | h | d | d | d | |
| 6 | h | h | h | h | h | h | h | h | h | h | h | d | d | |
| 7 | h | h | h | h | h | h | h | h | h | h | h | h | d | |
| 8 | h | h | h | h | h | h | h | h | h | h | h | h | d | |
| 9 | r | r | h | h | h | h | h | h | h | h | h | h | h | |
| T | r | r | r | h | h | h | h | h | h | h | h | h | h | |
| J | r | r | r | r | r | h | h | h | h | h | h | h | h | |
| Q | r | r | r | r | r | h | h | h | h | h | h | h | h | |
| K | r | r | r | r | r | r | h | h | h | h | h | h | h | |

*Hit if surrender is not allowed.

-continued

2-Card Strategy
Rows are the 1st card and columns are the 2nd card.

| — | A | 2 | 3 | 4 | 5 | 6 | 7 | 8 | 9 | T | J | Q | K |
|---|---|---|---|---|---|---|---|---|---|---|---|---|---|
| 9 | h | b | b | b | b | s | s | s | h | h | h | s | s |
| T | h | b | b | b | b | b | s | s | s | h | h | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 4 up:

| | | | | | | | | | | | | | |
|---|---|---|---|---|---|---|---|---|---|---|---|---|---|
| A | h | h | h | h | h | h | h | h | h | h | h | s | s |
| 2 | h | h | h | h | h | h | h | h | h | h | h | s | s |
| 3 | h | s | h | h | h | h | h | h | h | h | h | s | s |
| 4 | h | s | s | h | h | h | h | h | h | h | h | s | s |
| 5 | h | s | s | s | h | h | h | h | h | h | h | s | s |
| 6 | h | b | s | s | s | h | h | h | h | h | h | s | s |
| 7 | h | b | b | s | s | s | h | h | h | h | h | s | s |
| 8 | h | b | b | b | s | s | s | h | h | h | h | s | s |
| 9 | h | b | b | b | b | s | s | s | h | h | h | s | s |
| T | h | b | b | b | b | b | s | s | s | h | h | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 5 up:

| | | | | | | | | | | | | | |
|---|---|---|---|---|---|---|---|---|---|---|---|---|---|
| A | h | h | h | h | h | h | h | h | h | h | h | s | s |
| 2 | h | h | h | h | h | h | h | h | h | h | h | s | s |
| 3 | h | s | h | h | h | h | h | h | h | h | h | s | s |
| 4 | h | s | s | h | h | h | h | h | h | h | h | s | s |
| 5 | h | s | s | s | h | h | h | h | h | h | h | s | s |
| 6 | h | b | s | s | s | h | h | h | h | h | h | s | s |
| 7 | h | b | b | s | s | s | h | h | h | h | h | s | s |
| 8 | h | b | b | b | s | s | s | h | h | h | h | s | s |
| 9 | h | b | b | b | b | s | s | s | h | h | h | s | s |
| T | h | b | b | b | b | b | s | s | s | h | h | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 6 up:

| | | | | | | | | | | | | | |
|---|---|---|---|---|---|---|---|---|---|---|---|---|---|
| A | h | h | h | h | h | h | h | h | h | h | s | s | s |
| 2 | h | h | h | h | h | h | h | h | h | h | s | s | s |
| 3 | h | s | h | h | h | h | h | h | h | h | s | s | s |
| 4 | h | s | s | h | h | h | h | h | h | h | s | s | s |
| 5 | h | s | s | s | h | h | h | h | h | h | s | s | s |
| 6 | h | b | s | s | s | h | h | h | h | h | s | s | s |
| 7 | h | b | b | s | s | s | h | h | h | h | s | s | s |
| 8 | h | b | b | b | s | s | s | h | h | h | s | s | s |
| 9 | h | b | b | b | b | s | s | s | h | h | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 7 up:

| | | | | | | | | | | | | | |
|---|---|---|---|---|---|---|---|---|---|---|---|---|---|
| A | h | h | h | h | h | h | h | h | h | s | s | s | s |
| 2 | h | h | h | h | h | h | h | h | h | s | s | s | s |
| 3 | h | s | h | h | h | h | h | h | h | s | s | s | s |
| 4 | h | s | s | h | h | h | h | h | h | s | s | s | s |
| 5 | h | s | s | s | h | h | h | h | h | s | s | s | s |
| 6 | h | b | s | s | s | h | h | h | h | s | s | s | s |
| 7 | h | b | b | s | s | s | h | h | h | s | s | s | s |
| 8 | h | b | b | b | s | s | s | h | h | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 8 up:

| | | | | | | | | | | | | | |
|---|---|---|---|---|---|---|---|---|---|---|---|---|---|
| A | h | h | h | h | h | h | h | h | h | s | s | s | s |
| 2 | h | h | h | h | h | h | h | h | h | s | s | s | s |
| 3 | h | s | h | h | h | h | h | h | h | s | s | s | s |
| 4 | h | s | s | h | h | h | h | h | h | s | s | s | s |
| 5 | h | s | s | s | h | h | h | h | h | s | s | s | s |
| 6 | h | b | s | s | s | h | h | h | h | s | s | s | s |
| 7 | h | b | b | s | s | s | h | h | h | s | s | s | s |

-continued

2-Card Strategy
Rows are the 1st card and columns are the 2nd card.

| — | A | 2 | 3 | 4 | 5 | 6 | 7 | 8 | 9 | T | J | Q | K |
|---|---|---|---|---|---|---|---|---|---|---|---|---|---|
| 8 | h | b | b | b | s | s | s | h | h | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer 9 up:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | h | s | s | s | s |
| 3 | h | s | h | h | h | h | h | h | h | s | s | s | s |
| 4 | h | s | s | h | h | h | h | h | h | s | s | s | s |
| 5 | h | s | s | s | h | h | h | h | h | s | s | s | s |
| 6 | h | b | s | s | s | h | h | h | s | s | s | s | s |
| 7 | h | b | b | s | s | s | h | h | s | s | s | s | s |
| 8 | h | b | b | b | s | s | s | h | s | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer T up:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | s | h | h | h | h | h | h | s | s | s | s | s |
| 4 | h | s | s | h | h | h | h | h | s | s | s | s | s |
| 5 | h | s | s | s | h | h | h | h | s | s | s | s | s |
| 6 | h | b | s | s | s | h | h | h | s | s | s | s | s |
| 7 | h | b | b | s | s | s | h | h | s | s | s | s | s |
| 8 | h | b | b | b | s | s | s | h | s | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer J up:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | s | h | h | h | h | h | h | s | s | s | s | s |
| 4 | h | s | s | h | h | h | h | h | s | s | s | s | s |
| 5 | h | s | s | s | h | h | h | h | s | s | s | s | s |
| 6 | h | b | s | s | s | h | h | h | s | s | s | s | s |
| 7 | h | b | b | s | s | s | h | h | s | s | s | s | s |
| 8 | h | b | b | b | s | s | s | h | s | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer Q up:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | s | h | h | h | h | h | h | s | s | s | s | s |
| 4 | h | s | s | h | h | h | h | h | s | s | s | s | s |
| 5 | h | s | s | s | h | h | h | h | s | s | s | s | s |
| 6 | h | b | s | s | s | h | h | h | s | s | s | s | s |
| 7 | h | b | b | s | s | s | h | h | s | s | s | s | s |
| 8 | h | b | b | b | s | s | s | h | s | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

Dealer K up:

| | | | | | | | | | | | | | |
|---|---|---|---|---|---|---|---|---|---|---|---|---|---|
| A | h | h | h | h | h | h | h | s | s | s | s | s | s |
| 2 | h | h | h | h | h | h | h | h | s | s | s | s | s |
| 3 | h | s | h | h | h | h | h | h | s | s | s | s | s |
| 4 | h | s | s | h | h | h | h | h | s | s | s | s | s |
| 5 | h | s | s | s | h | h | h | h | s | s | s | s | s |
| 6 | h | b | s | s | s | h | h | h | s | s | s | s | s |

-continued

2-Card Strategy
Rows are the 1st card and columns are the 2nd card.

| — | A | 2 | 3 | 4 | 5 | 6 | 7 | 8 | 9 | T | J | Q | K |
|---|---|---|---|---|---|---|---|---|---|---|---|---|---|
| 7 | h | b | b | s | s | s | h | h | s | s | s | s | s |
| 8 | h | b | b | b | s | s | s | h | s | s | s | s | s |
| 9 | h | b | b | b | b | s | s | s | h | s | s | s | s |
| T | h | b | b | b | b | b | s | s | s | h | s | s | s |
| J | h | b | b | b | b | b | b | s | s | s | h | s | s |
| Q | h | b | b | b | b | b | b | b | s | s | s | h | s |
| K | h | b | b | b | b | b | b | b | b | s | s | s | h |

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| A up, 1st card A: | | | | | | | | | | | | | |
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 2: | | | | | | | | | | | | | |
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 3: | | | | | | | | | | | | | |
| A | h | h | h | h | h | h | h | h | s | s | s | s | s |
| 2 | b | b | b | b | b | b | b | b | b | b | b | b | b |
| 3 | h | h | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 4: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 5: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 6: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 7: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 8: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| A up, 1st card 9: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 9 | h | h | h | h | h | h | h | h | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

A up, 1st card T:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | h | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

A up, 1st card J:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | h | s | s | h | s | s |
| Q | h | b | b | b | b | b | b | b | b | b | b | h | s |
| K | h | b | b | b | b | b | b | b | b | b | b | b | h |

A up, 1st card Q:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | h | s | s | s | h | s |
| K | h | b | b | b | b | b | b | b | b | b | b | b | h |

A up, 1st card K:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | h | s | s | s | s | h |

2 up, 1st card A:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 2:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 3:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | h | h | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 4:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 5:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 6:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | h | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 7:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 8:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card 9:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | h | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card T:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | h | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

2 up, 1st card J:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | h | s | s | h | s | s |
| Q | h | b | b | b | b | b | b | b | b | b | b | h | s |
| K | h | b | b | b | b | b | b | b | b | b | b | b | h |

2 up, 1st card Q:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | h | s | s | s | h | s |
| K | h | b | b | b | b | b | b | b | b | b | b | b | h |

2 up, 1st card K:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | h | s | s | s | s | h |

3 up, 1st card A:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 2:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 3:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | h | h | h | h | h | h | h | h | s | s | s | s | s |
| 4 | h | b | b | h | h | h | h | h | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 4:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 5:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 6:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 7:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 8:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card 9:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | h | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card T:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | h | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

3 up, 1st card J:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | h | s | s | h | s | s |
| Q | h | b | b | b | b | b | b | b | b | b | b | h | s |
| K | h | b | b | b | b | b | b | b | b | b | b | b | h |

3 up, 1st card Q:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | h | s | s | s | h | s |
| K | h | b | b | b | b | b | b | b | b | b | b | b | h |

3 up, 1st card K:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | h | s | s | s | s | h |

4 up, 1st card A:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 2:

| | | | | | | | | | | | | | |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 3:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | h | h | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 4:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 5:

| | | | | | | | | | | | | | |
|---|---|---|---|---|---|---|---|---|---|---|---|---|---|
| A | h | h | h | h | h | h | h | h | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 6:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 7:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 8:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card 9:

| | | | | | | | | | | | | | |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | h | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card T:

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | h | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

4 up, 1st card J:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | h | s | s | h | s | s |
| Q | h | b | b | b | b | b | b | b | b | b | b | h | s |
| K | h | b | b | b | b | b | b | b | b | b | b | b | h |

4 up, 1st card Q:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | h | s | s | s | h | s |
| K | h | b | b | b | b | b | b | b | b | b | b | b | h |

4 up, 1st card K:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | h | s | s | s | s | h |

5 up, 1st card A:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

5 up, 1st card 2:

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | h | h | h | h | h | h | h | h | s | s | s | s | s |
| 3 | h | b | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

5 up, 1st card 3:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | h | h | h | h | h | h | h | h | s | s | s | s | s |
| 4 | h | b | b | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

5 up, 1st card 4:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | h | s | s | s | s | s |
| 5 | h | b | b | b | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

5 up, 1st card 5:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | h | s | s | s | s | s |
| 6 | h | b | b | b | b | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

5 up, 1st card 6:

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | h | s | s | s | s | s |
| 7 | h | b | b | b | b | b | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 5 up, 1st card 7: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | h | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 5 up, 1st card 8: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 5 up, 1st card 9: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | h | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 5 up, 1st card T: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | h | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 5 up, 1st card J: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | h | s | s | h | s | s |
| Q | h | b | b | b | b | b | b | b | b | b | b | h | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| K | h | b | b | b | b | b | b | b | b | b | b | b | h |
| 5 up, 1st card Q: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | h | s | s | s | h | s |
| K | h | b | b | b | b | b | b | b | b | b | b | b | h |
| 5 up, 1st card K: | | | | | | | | | | | | | |
| A | h | h | h | h | h | h | h | h | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | h | s | s | s | s | h |
| 6 up, 1st card A: | | | | | | | | | | | | | |
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 2: | | | | | | | | | | | | | |
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 3: | | | | | | | | | | | | | |
| A | h | h | h | h | h | h | h | s | s | s | s | s | s |
| 2 | b | b | b | b | b | b | b | b | b | b | b | b | b |
| 3 | h | h | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| Q | h | b | b | b | b | b | b | b | b | b | b | h | s |
| K | h | b | b | b | b | b | b | b | b | b | b | b | h |
| 6 up, 1st card 4: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 5: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 6: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 7: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 8: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card 9: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | s | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card T: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| 6 up, 1st card J: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | s | s | s | h | s | s |
| Q | h | b | b | b | b | b | b | b | b | b | b | h | s |
| K | h | b | b | b | b | b | b | b | b | b | b | b | h |
| 6 up, 1st card Q: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | s | s | s | s | h | s |
| K | h | b | b | b | b | b | b | b | b | b | b | b | h |
| 6 up, 1st card K: | | | | | | | | | | | | | |
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | s | s | s | s | s | h |

7 up, 1st card A:

| | | | | | | | | | | | | | |
|---|---|---|---|---|---|---|---|---|---|---|---|---|---|
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 2:

| | | | | | | | | | | | | | |
|---|---|---|---|---|---|---|---|---|---|---|---|---|---|
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 3:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | h | h | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 4:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 5:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 6:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 7:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 8:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card 9:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | h | s | h | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card T:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 8 | b | b | b | b | b | b | b | b | b | b | b | b | b |
| 9 | b | b | b | b | b | b | b | b | b | b | b | b | b |
| T | h | h | h | h | h | h | h | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

7 up, 1st card J:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | s | s | s | h | s | s |
| Q | h | b | b | b | b | b | b | b | b | b | b | h | s |
| K | h | b | b | b | b | b | b | b | b | b | b | b | h |

7 up, 1st card Q:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | s | s | s | s | h | s |
| K | h | b | b | b | b | b | b | b | b | b | b | b | h |

7 up, 1st card K:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | s | s | s | s | s | h |

8 up, 1st card A:

| | | | | | | | | | | | | | |
|---|---|---|---|---|---|---|---|---|---|---|---|---|---|
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 2:

| | | | | | | | | | | | | | |
|---|---|---|---|---|---|---|---|---|---|---|---|---|---|
| A | h | h | h | h | h | h | h | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 3:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | h | h | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 4:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 5:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 6:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 7:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 8:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card 9:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | s | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card T:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | h | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

8 up, 1st card J:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | h | s | s | s | h | s | s |
| Q | h | b | b | b | b | b | b | b | b | b | b | h | s |
| K | h | b | b | b | b | b | b | b | b | b | b | b | h |

8 up, 1st card Q:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | h | s | s | s | s | h | s |
| K | h | b | b | b | b | b | b | b | b | b | b | b | h |

8 up, 1st card K:

| | | | | | | | | | | | | | |
|---|---|---|---|---|---|---|---|---|---|---|---|---|---|
| A | h | h | h | h | h | h | h | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | h | s | s | s | s | s | h |

9 up, 1st card A:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 2:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | h | s | s | s | s | s | s |
| 3 | h | b | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 3:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | h | h | h | h | h | h | h | s | s | s | s | s | s |
| 4 | h | b | b | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 4:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 4 | h | h | h | h | h | h | h | s | s | s | s | s | s |
| 5 | h | b | b | b | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 5:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | h | s | s | s | s | s | s |
| 6 | h | b | b | b | b | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 6:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | h | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 7:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 8:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | s | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card 9:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | s | s | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card T:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | s | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

9 up, 1st card J:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | s | s | s | s | h | s | s |
| Q | h | b | b | b | b | b | b | b | b | b | b | h | s |
| K | h | b | b | b | b | b | b | b | b | b | b | b | h |

9 up, 1st card Q:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | s | s | s | s | s | h | s |
| K | h | b | b | b | b | b | b | b | b | b | b | b | h |

9 up, 1st card K:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | s | s | s | s | s | s | h |

T up, 1st card A:

| | | | | | | | | | | | | | |
|---|---|---|---|---|---|---|---|---|---|---|---|---|---|
| A | h | h | h | h | h | h | s | s | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 2:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 3:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | h | h | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 4:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 5:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 6:

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 7:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 8:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | s | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card 9:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | s | s | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card T:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | s | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

T up, 1st card J:

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | s | s | s | s | h | s | s |
| Q | h | b | b | b | b | b | b | b | b | b | b | h | s |
| K | h | b | b | b | b | b | b | b | b | b | b | b | h |

T up, 1st card Q:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | s | s | s | s | s | h | s |
| K | h | b | b | b | b | b | b | b | b | b | b | b | h |

T up, 1st card K:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | s | s | s | s | s | s | h |

J up, 1st card A:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

J up, 1st card 2:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|

J up, 1st card 3:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | h | h | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

J up, 1st card 4:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

J up, 1st card 5:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

J up, 1st card 6:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

J up, 1st card 7:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| K | h | b | b | b | b | b | b | b | b | b | b | b | h |
| J up, 1st card 8: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | s | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| J up, 1st card 9: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | s | s | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| J up, 1st card T: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | s | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| J up, 1st card J: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | s | s | s | s | h | s | s |
| Q | h | b | b | b | b | b | b | b | b | b | b | h | s |
| K | h | b | b | b | b | b | b | b | b | b | b | b | h |
| J up, 1st card Q: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| Q | h | h | h | h | h | h | s | s | s | s | s | h | s |
| K | h | b | b | b | b | b | b | b | b | b | b | b | h |
| J up, 1st card K: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | s | s | s | s | s | s | h |
| Q up, 1st card A: | | | | | | | | | | | | | |
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 2: | | | | | | | | | | | | | |
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 3: | | | | | | | | | | | | | |
| A | h | h | h | h | h | h | s | s | s | s | s | s | s |
| 2 | b | b | b | b | b | b | b | b | b | b | b | b | b |
| 3 | h | h | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 4: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 5: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 6: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 7: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 8: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | s | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card 9: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | s | s | h | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card T: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | s | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |
| Q up, 1st card J: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | s | s | s | s | h | s | s |
| Q | h | b | b | b | b | b | b | b | b | b | b | h | s |
| K | h | b | b | b | b | b | b | b | b | b | b | b | h |
| Q up, 1st card Q: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | s | s | s | s | s | h | s |
| K | h | b | b | b | b | b | b | b | b | b | b | b | h |
| Q up, 1st card K: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | s | s | s | s | s | s | h |
| K up, 1st card A: | | | | | | | | | | | | | |
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 2:

| | | | | | | | | | | | | | |
|---|---|---|---|---|---|---|---|---|---|---|---|---|---|
| A | h | h | h | h | h | h | s | s | s | s | s | s | s |
| 2 | h | h | h | h | h | h | s | s | s | s | s | s | s |
| 3 | h | b | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 3:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | h | h | h | h | h | h | s | s | s | s | s | s | s |
| 4 | h | b | b | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 4:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | h | h | h | h | h | h | s | s | s | s | s | s | s |
| 5 | h | b | b | b | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 5:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | h | h | h | h | h | h | s | s | s | s | s | s | s |
| 6 | h | b | b | b | b | h | s | s | s | s | s | s | s |
| 7 | h | b | b | b | b | b | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 6:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | h | h | h | h | h | h | s | s | s | s | s | s | s |
| 7 | h | b | b | b | b | b | h | s | s | s | s | s | s |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 7:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | h | h | h | h | h | h | h | s | s | s | s | s | s |
| 8 | h | b | b | b | b | b | b | h | s | s | s | s | s |
| 9 | h | b | b | b | b | b | b | b | h | s | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card 8:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | h | h | h | h | h | h | h | s | h | s | s | s | s |
| 9 | h | b | b | b | b | b | b | b | b | h | s | s | s |
| T | h | b | b | b | b | b | b | b | b | b | h | s | s |
| J | h | b | b | b | b | b | b | b | b | b | b | h | s |
| Q | h | b | b | b | b | b | b | b | b | b | b | b | h |
| K | h | b | b | b | b | b | b | b | b | b | b | b | b |

K up, 1st card 9:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | h | h | h | h | h | h | h | s | s | h | s | s | s |
| T | h | b | b | b | b | b | b | b | b | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card T:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | h | h | h | h | h | h | s | s | s | h | s | s | s |
| J | h | b | b | b | b | b | b | b | b | b | h | s | s |
| Q | h | b | b | b | b | b | b | b | b | b | b | h | s |
| K | h | b | b | b | b | b | b | b | b | b | b | b | h |

K up, 1st card J:

| | | | | | | | | | | | | | |
|---|---|---|---|---|---|---|---|---|---|---|---|---|---|
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |

-continued

3-Card Strategy
Rows are the 2nd card and columns are the 3rd card.

| — | A | 2 | 3 | 4 | 5 | 6 | 7 | 8 | 9 | T | J | Q | K |
|---|---|---|---|---|---|---|---|---|---|---|---|---|---|
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | h | h | h | h | h | h | s | s | s | s | h | s | s |
| Q | h | b | b | b | b | b | b | b | b | b | b | h | s |
| K | h | b | b | b | b | b | b | b | b | b | b | b | h |
| K up, 1st card Q: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | h | h | h | h | h | h | s | s | s | s | s | h | s |
| K | h | b | b | b | b | b | b | b | b | b | b | b | h |
| K up, 1st card K: | | | | | | | | | | | | | |
| A | h | h | h | h | h | h | s | s | s | s | s | s | s |
| 2 | b | b | b | b | b | b | b | b | b | b | b | b | b |
| 3 | b | b | b | b | b | b | b | b | b | b | b | b | b |
| 4 | b | b | b | b | b | b | b | b | b | b | b | b | b |
| 5 | b | b | b | b | b | b | b | b | b | b | b | b | b |
| 6 | b | b | b | b | b | b | b | b | b | b | b | b | b |
| 7 | b | b | b | b | b | b | b | b | b | b | b | b | b |
| 8 | b | b | b | b | b | b | b | b | b | b | b | b | b |
| 9 | b | b | b | b | b | b | b | b | b | b | b | b | b |
| T | b | b | b | b | b | b | b | b | b | b | b | b | b |
| J | b | b | b | b | b | b | b | b | b | b | b | b | b |
| Q | b | b | b | b | b | b | b | b | b | b | b | b | b |
| K | h | h | h | h | h | h | s | s | s | s | s | s | h |

It should be apparent to one of ordinary skill in the art that the game could be played in reverse, with players attempting to take hits to obtain a card of lower value then the previous card. The rules and values could be correspondingly similar to the preferred Keep 'Em Coming™ game with appropriate adjustments.

There are additional options and variations that may be played in the practice of the basic underlying game without deviating from the basic game structure of the invention. The game may be played with virtual cards, as with a video stand-alone single player apparatus. The game may be played as a multi-player console format, with a single dealer's virtual hand an individual for each player or player position where a wager is placed. The dealer's hand is played automatically by a game controller in such systems, so that the fixed rules of play for a dealer are automatically executed.

An Ace can be considered a swing card during play of the game, both for the dealer and for the player. In one format or rule of play, in determining whether a hit exceeds the previous card, an Ace always exceeds the previous card (unless the previous card was also an Ace). In determining rank for the next hit, the Ace may be treated as the lowest card, so that any card except for another Ace exceeds the rank of the hit that was an Ace. For example, if the initial card was a Jack and the first hit was an Ace, the next card need be only a rank of 2 or better to exceed the rank of the Ace.

The Ace may also be used to freeze the rank of the previous card. For example, if the first card were a 2, the next hit was a 6, and then an Ace was received, then the next hit card (if elected by the player), need only be a rank of 7 or higher.

If a player receives a pair (a card that exactly matches the rank of the previous card), the player receives a "Free Card." Even if the rank of the Free Card is lower than the rank of the pair, the player does not bust, and may continue to hit. The rules of play may allow for the "Free Card" itself to count or not to count in totaling the number of cards received by the player or the dealer. The Free Card play may be available to only the player or to the player and the dealer. The count rules may also differ as between the player and the dealer. For example, the player may or may not be able to count the Free Card as a hit, and the dealer independently may or may not be able to count the Free Card as a hit. These may be house rules, or rules elected (e.g., on an automated apparatus) by the player.

The player may be able to double the initial wager after viewing the first card in the player's hand. After receiving the first hit card, the player is either already busted, elects to stand with a count of two cards, or elects to take an additional hit. The player may elect to take up to a maximum of 6 hits. Bonuses may be awarded for receiving six total cards without busting.

Another option is referred to as "Close Enough" play. Usually on the first two cards only, if the player has busts on the first two cards (the initial card and the first hit), and the degree of bust (the difference in rank of cards) exceeds a predetermined amount (e.g., at least three ranks different, at least four ranks different, at least 5 or 6 ranks different, etc.), the dealer announces, "Close Enough!" The player then remains in the game with a count of two. This event may or may not be available to the players or may or may not be available to the dealer, independently according to house rules.

As an alternative to "Close Enough" play, a different method of play for the mandatory second card would be the exclusion of "Close Enough," and the inclusion of "Safe Suit." If the player's mandatory card is lower than the rank or count of the first card, but the suit of the mandatory card is the same as the first card, the hand does not bust. More cards may or may not be drawn to the two-card hand, according to local rules. The dealer may or may not get the advantage of Safe Suit, and may or may not get the advantage of the Free Card after Pairing. The player may or may not be allowed to double or triple down as directed by local rules.

An alternate method of play would increase the maximum number of cards per hand to seven. The play would incorporate the rules of the basic game herein known as "Keep 'em Coming", with the addition of a bonus feature. The bonus feature, called "7-card Savannah", allows the player to automatically win 7× his bet if the said player has achieved a 7-card hand, and the dealer has achieved a hand of 1 to 6 cards. However, if the dealer also achieves a 7-card hand, the game is a push (tie). There may be an "insurance" bet that guarantees the player an automatic reduced payoff (4-to-1, for example) for an additional wager of up to the initial wager. In general, all ties in the number of sequenced rank of cards in a hand without busting are pushes (although a bonus may be automatic for a player's six card hand). Whenever the dealer's hand has more cards than a player's hand, the player loses. Whenever the dealer's hand has fewer cards than a player's hand, the player wins.

Other options include a dealer not qualifying for a Free Card. In this manner, when the Dealer gets a pair, the dealer hand busts if the next card is lower in rank. The paired card would then most likely count in the dealer's hand total card count, but rules may exclude the paired card if desired. The rules may allow for either the player or the dealer to win all ties. The player may be allowed to double his bet on certain cards, or only against certain dealer cards. The player may not be allowed to double an initial wager after the first card has been shown (e.g., turned up from an initial first down card) and he has seen the dealer's first card (e.g., dealt face up).

What is claimed:

1. A method of playing a wagering game with playing cards in which a dealer competes against a player, the game comprising:

at least one player placing a wager on the game;

the at least one player and the dealer each receiving a single card with a rank from a set of cards to form an at least one player hand and a dealer hand;

the at least one player taking at least one mandatory additional card attempting to receive a first additional card having a specific relationship in rank to the single card in the at least one player hand, the specific relationship being selected from the group consisting of cards being sequentially higher in rank and sequentially lower in rank;

if the at least one mandatory additional card has the specific relationship in rank to the single card, or if the at least one mandatory additional card allows the at least one player to continue the game, the player exercises an option of taking another additional card or standing, attempting to receive another additional card having a specific relationship in rank to the first additional card;

when the player has elected to take no more additional cards or has taken a maximum number of additional cards allowed, attempting again to receive successive additional cards having the specific relationship to a previous additional card, but has not taken a card that busts the at least one player's hand by not having the specific relationship to the previous additional card, the dealer takes at least one mandatory additional card attempting to receive a first additional card having a specific relationship in rank to the single card in the dealer's hand, the dealer taking additional cards attempting again to receive successive additional cards having the specific relationship to a previous additional card until the dealer busts by not having the specific relationship to the previous additional card, until the dealer has taken a maximum number of additional cards allowed, or until the dealer has received a total number of cards that exceeds the total number of cards in all players' hands in the game; and resolving the wager on the game.

2. The method of claim 1 wherein the specific relationship in rank is that an additional card has a rank that is less then the rank of the previous card received in the hand.

3. The method of claim 2 wherein if the mandatory card is higher than the first card by a value difference of 3 or less, the player does not bust, but remains as a 2-card hand without the benefit of continued drawing.

4. The method of claim 2 wherein if the single card of the dealer has a specific rank, the player is allowed to double the wager on the game.

5. The method of claim 2 wherein if the single card of the dealer has a specific rank, the player is allowed to triple the wager on the game.

6. The method of claim 2 wherein resolving the wager comprises multiplying the wager by a factor related to a difference in number of cards between the at least one player's hand and the dealer's hand.

7. The method of claim 3 wherein the maximum number of cards equals six cards.

8. The method of claim 2 wherein the dealer must continue taking hits additional cards until the dealer hand busts, but the dealer hand is in play for a number of cards attained before busting.

9. The method of claim 2 wherein a maximum number of cards that any player hand or dealer hand may receive is seven cards.

10. The method of claim 9 wherein a bonus amount may be won by a player for receiving a predetermined number of cards in the player's hand without busting.

11. The method of claim 2 wherein if the mandatory card matches suit with the single card, the player does not bust, and the player may continue drawing or not continue drawing additional cards.

12. The method of claim 1 wherein if the mandatory card is lower than the first card by a value difference of 3 or less, the player does not bust, but remains as a 2-card hand without the benefit of continued drawing.

13. The method of claim 1 wherein if the single card of the dealer has a specific rank, the player is allowed to double the wager on the game.

14. The method of claim 1 wherein if the single card of the dealer has a specific rank, the player is allowed to triple the wager on the game.

15. The method of claim 1 wherein resolving the wager comprises multiplying the wager by a factor related to a difference in number of cards between the at least one player's hand and the dealer's hand.

16. The method of claim 1 wherein the maximum number of cards equals six cards.

17. The method of claim 1 wherein the dealer must continue taking additional cards until the dealer hand busts, but the dealer hand is in play for a number of cards attained before busting.

18. The method of claim 1 wherein cards are provided to the at least one player and the dealer as virtual cards on a display.

19. The method of claim 1 played on a video gaming apparatus with a single player, wherein cards are provided to the at least one player and the dealer as virtual cards on a display.

20. The method of claim 1 wherein a maximum number of cards that any player hand or dealer hand may receive is seven cards.

21. The method of claim 20 wherein a bonus amount may be won by a player for receiving a predetermined number of cards in the player's hand without busting.

22. The method of claim 1 wherein the dealer must continue taking additional cards until the dealer hand busts or exceeds the total number of cards in each player's hand, and the dealer hand is in play for a total number of cards in the dealer's hand attained before busting.

23. The method of claim 1 wherein the specific relationship in rank is that an additional card has a rank that is higher then the rank of the previous card received in the hand.

24. The method of claim 23 wherein if the mandatory card matches suit with the single card, the player does not bust, and the player may continue drawing or not continue drawing additional cards.

25. A method of playing a wagering game with playing cards in which a dealer competes against a player, the game comprising:

at least one player placing a wager on the game:

the at least one player and the dealer each receiving a single card with a rank from a set of cards to form an at least one player hand and a dealer hand:

the at least one player taking at least one mandatory additional card attempting to receive a first additional card having a specific relationship in rank to the single card in the at least one player hand, the specific relationship being selected from the group consisting of cards being sequentially higher in rank and sequentially lower in rank:

if the at least one mandatory additional card has the specific relationship in rank to the single card, or if the at least one mandatory additional card allows the at least one player to continue the game, the player exercises an option of taking another additional card or standing, attempting to receive another additional card having a specific relationship in rank to the first additional card:

when the player has elected to take no more additional cards or has taken a maximum number of additional cards allowed, attempting again to receive successive additional cards having the specific relationship to a previous additional card, but has not taken a card that busts the at least one player's hand by not having the specific relationship to the previous additional card, the dealer takes at least one mandatory additional card attempting to receive a first additional card having a specific relationship in rank to the single card in the dealer's hand, the dealer taking additional cards attempting again to receive successive additional cards having the specific relationship to a previous additional card until the dealer busts by not having the specific relationship to the previous additional card, until the dealer has taken a maximum number of additional cards allowed, or until the dealer has received a total number of cards that exceeds the total number of cards in all players' hands in the game: and resolving the wager on the game:

wherein the specific relationship in rank is that an additional card exceeds the rank of the previous card received in the hand receiving an additional card, and wherein if an additional card matches the rank of the previous card received in either a player hand or dealer hand, that player hand or dealer hand remains active in play of the wagering game and that player hand or dealer hand automatically receives another additional card that cannot bust the hand.

26. The method of claim 25 wherein resolving the wager comprises multiplying the wager by a factor related to a difference in number of cards between the at least one player's hand and the dealer's hand.

27. A method of playing a wagering game with playing cards in which a dealer competes against a player, the game comprising:

at least one player placing a wager on the game:

the at least one player and the dealer each receiving a single card with a rank from a set of cards to form an at least one player hand and a dealer hand:

the at least one player taking at least one mandatory additional card attempting to receive a first additional card having a specific relationship in rank to the single card in the at least one player hand, the specific relationship being selected from the group consisting of cards being sequentially higher in rank and sequentially lower in rank:

if the at least one mandatory additional card has the specific relationship in rank to the single card, or if the at least one mandatory additional card allows the at least one player to continue the game, the player exercises an option of taking another additional card or standing, attempting to receive another additional card having a specific relationship in rank to the first additional card:

when the player has elected to take no more additional cards or has taken a maximum number of additional cards allowed, attempting again to receive successive additional cards having the specific relationship to a previous additional card, but has not taken a card that busts the at least one player's hand by not having the specific relationship to the previous additional card, the dealer takes at least one mandatory additional card attempting to receive a first additional card having a specific relationship in rank to the single card in the dealer's hand, the dealer taking additional cards attempting again to receive successive additional cards having the specific relationship to a previous additional card until the dealer busts by not having the specific relationship to the previous additional card, until the dealer has taken a maximum number of additional cards allowed, or until the dealer has received a total number of cards that exceeds the total number of cards in all players' hands in the game: and resolving the wager on the game:

wherein the specific relationship in rank is that an additional card has a rank that is less then the rank of the previous card received in the hand: and wherein if an additional card matches the rank of the previous card received in either a player hand or dealer hand, that player hand or dealer hand remains active in play of the wagering game and that player hand or dealer hand automatically receives another additional card that cannot bust the hand.

28. The method of claim 2 wherein resolving the wager comprises multiplying the wager by a factor related to a difference in number of cards between the at least one player's hand and the dealer's hand.

29. A method of playing a wagering game with playing cards in which a dealer competes against a player, the game comprising:

at least one player placing a wager on the game;

the at least one player and the dealer receiving a single card with a rank from a set of cards to form an at least one player hand and a dealer hand;

the at least one player taking at least one mandatory additional card attempting to receive a first additional card having a specific relationship in rank to the single card in the at least one player hand, the specific relationship in rank being selected from the group consisting of cards being sequentially higher in rank and sequentially lower in rank;

if the at least one mandatory additional card has the specific relationship in rank to the single card, or if the at least one mandatory additional card allows the at least one player to continue the game, the player having the option of taking another additional card, attempting to receive another additional card having a specific relationship in rank to the first additional card;

when the player has elected to take no more additional cards or has taken a maximum number of hits, but has not taken a card that bust the at least one player's hand by not having the specific relationship to the previous additional card, the dealer taking at least one mandatory additional card attempting to receive a first additional card having a specific relationship in rank to the single card in the dealer hand, the dealer taking additional cards until the dealer busts, the dealer card count being a number less then the total cards received including the bust card; and resolving the wager on the game.

* * * * *

UNITED STATES PATENT AND TRADEMARK OFFICE

CERTIFICATE OF CORRECTION

PATENT NO. : 7,185,891 B2
APPLICATION NO. : 10/823387
DATED : March 6, 2007
INVENTOR(S) : Kathleen Nylund Jackson It is certified that error appears in the above-identified patent and that said Letters Patent is hereby corrected as shown below:

Title page, section 54, please cancel line 1 and insert the following:

KEEP 'EM COMING CARD GAME

Column 1, please cancel line 1 and insert the following:

KEEP 'EM COMING CARD GAME

Signed and Sealed this

Twenty-ninth Day of May, 2007

JON W. DUDAS
*Director of the United States Patent and Trademark Office*